US011299949B2

(12) United States Patent
Cardno et al.

(10) Patent No.: US 11,299,949 B2
(45) Date of Patent: Apr. 12, 2022

(54) THERMAL APPARATUS AND ASSOCIATED METHODS

(71) Applicant: Clearwell Technology LTD, Aberdeenshire (GB)

(72) Inventors: Bruce Cardno, Aberdeenshire (GB); Paul Ray, Aberdeenshire (GB)

(73) Assignee: CLEARWELL TECHNOLOGY LTD, Aberdeenshire (GB)

( * ) Notice: Subject to any disclaimer, the term of this patent is extended or adjusted under 35 U.S.C. 154(b) by 256 days.

(21) Appl. No.: 16/479,726

(22) PCT Filed: Jan. 18, 2018

(86) PCT No.: PCT/GB2018/050151
§ 371 (c)(1),
(2) Date: Jul. 22, 2019

(87) PCT Pub. No.: WO2018/138479
PCT Pub. Date: Aug. 2, 2018

(65) Prior Publication Data

US 2021/0324697 A1 Oct. 21, 2021

(30) Foreign Application Priority Data

Jan. 25, 2017 (GB) ..... 1701224
Aug. 1, 2017 (GB) ..... 1712344

(51) Int. Cl.
*E21B 29/02* (2006.01)
*E21B 36/00* (2006.01)

(52) U.S. Cl.
CPC ..... *E21B 29/02* (2013.01); *E21B 36/00* (2013.01)

(58) Field of Classification Search
CPC ..... E21B 7/146; E21B 36/00; E21B 29/02
See application file for complete search history.

(56) References Cited

U.S. PATENT DOCUMENTS 1,631,290 A * 6/1927 Johnm ..... E21C 37/16 299/14
3,588,303 A 6/1971 Karrer
(Continued)

FOREIGN PATENT DOCUMENTS

CN 2257508 Y 7/1997
CN 2670584 Y 1/2005
(Continued)

OTHER PUBLICATIONS

Examination Report on corresponding European Application 18701223.2 dated Aug. 31, 2020.
(Continued)

*Primary Examiner* — Christopher J Sebesta
(74) *Attorney, Agent, or Firm* — Carlson, Gaskey & Olds, P.C.

(57) ABSTRACT

Embodiments comprise a method of removing material at a well, involving progressively jetting heat along a helical path to heat a target material for removal. Embodiments of the method comprise material removal from a downhole well element, involving running in a downhole assembly with a downhole heating device comprising a fuel towards a target location. For example, such embodiments provide an alternative method for the removal of wellbore tubulars, using a rapid oxidation process to significantly alter the physical state of the tubular well element and reduce it to an oxide deviate, thereby facilitating an area where a more conventional barrier can be installed in the wellbore.

18 Claims, 13 Drawing Sheets

(56) References Cited

U.S. PATENT DOCUMENTS

| | | | | |
|---|---|---|---|---|
| 3,602,620 | A * | 8/1971 | Fassler | E21B 7/146 431/99 |
| 4,864,093 | A * | 9/1989 | Henderson | B23K 35/0216 219/70 |
| 5,385,336 | A | 1/1995 | Gurinov et al. | |
| 5,816,747 | A | 10/1998 | Welch et al. | |
| 6,598,679 | B2 * | 7/2003 | Robertson | E21B 29/02 166/297 |
| 2005/0029717 | A1 | 2/2005 | Ericksson et al. | |
| 2008/0257549 | A1 | 10/2008 | Swor et al. | |
| 2009/0266552 | A1 * | 10/2009 | Barra | E21B 19/002 166/339 |
| 2016/0130903 | A1 | 5/2016 | Robertson et al. | |
| 2016/0341478 | A1 | 11/2016 | Peña Astorga | |

FOREIGN PATENT DOCUMENTS

| | | | |
|---|---|---|---|
| CN | 202804433 | U | 3/2013 |
| GB | 2523174 | A | 8/2015 |
| GB | 2528054 | A | 1/2016 |
| GB | 2532609 | A | 5/2016 |
| WO | 2016/067020 | A1 | 5/2016 |

OTHER PUBLICATIONS

Examination Report on corresponding Chinese Application 2018800194925 dated Aug. 26, 2020.

Examination Reporton corresponding European Application 18701223.2 dated May 4, 2020.

International Search Report and Written Opinion for International Application No. PCT/GB2018/050151 dated Apr. 23, 2018.

United Kingdom Combined Search and Examination Report for Application No. GB1712344.9 dated Sep. 15, 2017.

Examination Reporton corresponding Chinese Application No. 2018800194925 dated Jun. 3, 2021.

Examination report on corresponding Chinese Application 201880019492.5 dated Oct. 23, 2021.

* cited by examiner

THERMAL APPARATUS AND ASSOCIATED METHODS

TECHNICAL FIELD

This disclosure concerns material removal methods, and associated apparatus. For example, the disclosure concerns material removal methods and associated apparatus for heating and/or oxidizing material, such as for removal. In particular, but not exclusively, examples of the disclosure concern methods of removing well or downhole material, such as for well abandonment.

BACKGROUND

Material removal can often be effected by mechanical, chemical, thermal or electrical energy. Generally some form of bond is broken to allow displacement of the material, sometimes with the material undergoing a chemical, phase or other material change of property. The type of material removal method typically depends upon the material; and often on the location or environment of the material to be removed. For example, material removal in enclosed volumes, such as passages, particularly inaccessible bores or conduits, can be influenced geometrically by the dimensions of the enclosed volume and whether an exterior of the enclosed volume is accessible for material removal. Downhole material removal of or from downhole bores generally involves access through the bore itself.

Subterranean bores, such as those drilled for accessing underground hydrocarbon reservoirs, are usually cased or lined to maintain bore stability or integrity and to assist in fluid transportation along the bore. Especially production bores are usually lined or cased with tubular members, such as steel or composite casing or liner, which is typically cemented in place.

If a bore is unproductive or becomes unproductive, or is not viable for any reason, then the bore is typically terminated with a plug and abandonment operation. Plugging and abandoning is generally intended to prevent unintended leakage of fluids out of (or into) the bore, such as an undesired passage of oil or gas into the surrounding environment (e.g. a marine environment at the wellhead or bore opening). If a bore is to become abandoned, many territories stipulate requirements regulating plugging and abandonment to mitigate against such potential environmental damage.

The subject matter of at least some examples of the present disclosure may be directed to overcoming, or at least reducing the effects of, one or more of the problems of the prior art, such as may be described above.

SUMMARY

According to a first aspect there is provided a method of material removal. The method may comprise heating a target material to be removed. The method may comprise an oxidation of a fuel. The oxidation of the fuel may oxidise and/or heat the target material to be removed. The method may comprise weakening the target material for removal. The oxidation and/or the heating of the target material to be removed may remove the target material. The heating of the target material may at least partially soften the target material. The heating of the target material may at least partially melt the target material. The oxidation and/or heating of the target material may cause its direct removal. Additionally or alternatively, the oxidation and/or the heating of the target material to be removed may prepare the target material for removal. For example, the oxidation and/or heating of the target material may weaken the target material. The target material may be removed or displaced. Material removal may comprise removing the material from one location to another, such as from a first location in or at a well to a second location in or at the well; or the The method may comprise at least a partial oxidation of material. The method may comprise the partial oxidation of material. The method may comprise oxidizing the material in situ. The method may comprise the oxidation of the material to facilitate the removal of the material. The method may comprise the removal of the oxidized or partially oxidized material.

The method may comprise removing material of and/or from an enclosed volume, such as a passage. In at least some examples, the enclosed volume may comprise a well volume, such as a well bore or associated well installation volume (e.g. a caisson, or other surface installation).

The material may comprise a downhole material. Accordingly, the method may comprise a method of downhole material removal. The method may comprise oxidizing the downhole material. The method may comprise the oxidation of the downhole material to facilitate the removal of the downhole material. The method may comprise the removal of the oxidized downhole material.

The method may comprise a plugging method, such as for abandonment. The method may comprise a tubing removal. The method may comprise a tubing removal to allow placement of a plug or seal at the location of the removed tubing. The tubing may comprise one or more of: a tubular/s; a casing/s; a liner/s.

The method may comprise the targeted oxidation of target downhole material at a target location. The method may comprise running in an apparatus, such as a downhole assembly, to or towards the target location. The apparatus may comprise a heat source; and/or a fuel supply; and/or an oxidant supply. The heat source may comprise a thermal or heating device. The heating device may comprise a heating member. The heating device may comprise a thermic lance. The heating device may comprise a fuel. The heating device may comprise a container for housing at least the fuel. The housing may comprise a consumable, such as a fuel material. In at least some examples, the heating device comprises a sheath housing a plurality of metal components, such as steel and/or magnesium and/or aluminium fuel rods. The sheath may comprise a similar material to the fuel housed within. The sheath may be configured to be consumed at an axial rate similar to the fuel housed within. Additionally, or alternatively, fuel may be supplied downhole, such as via a passage from uphole (e.g. via a conduit or annulus from a surface source). In at least some examples, supply of the fuel may be controlled. Fuel may be supplied in a mixture, such as a metal powder mixed in a carrier fluid. In at least some examples, the fuel comprises the target downhole material. For example, the target downhole material may provide energy exothermally as it oxidizes. The fuel may comprise at least a portion of the target material. In at least some examples, the target downhole material provides a primary source of fuel, at least after initiation. Particularly where there is a large volume of target downhole material, the target downhole material may provide a sole source of fuel after initiation.

The method may comprise supplying the oxidizing agent, such as via a conduit or annulus from an uphole location (e.g. from a surface source or container uphole of the heating device). The method may comprise supplying the oxidizing agent, such as liquid or gaseous oxygen, internally. For example, the method may comprise providing the oxidizing agent via an internal conduit; such as through coiled tubing or the like to a container or sheath, such as of a thermic lance. The method may comprise supplying the oxidizing agent externally, such as externally to the heating device or heating member. For example, the method may comprise supplying the oxidizing agent via one or more annulus. The method may comprise supplying the oxidizing agent between the heating device or heating member and the target material. For example, the method may comprise supplying the oxidizing agent to and/or through an annulus or conduit in which the heating device and/or heating member is located. In at least some examples, the oxidizing agent's may be supplied both internally and externally. The method may comprise supplying the oxidizing agent to the target material and/or the heating member. The method may comprise actively providing the oxidizing agent, such as pumping and/or pressurizing the oxidizing agent.

The method may comprise applying the heating device downhole. The heating device may directly and/or indirectly heat the target material to be removed at the target location. The heating device may heat the target material directly by conduction and/or radiation. Additionally or alternatively, the heating device may heat the target material indirectly, such as by heating an intermediate medium. The intermediate medium may comprise one or more of: the fuel; oxidizing agent; oxygen; a carrier medium; the housing; and/or oxidized or removed material. Additionally or alternatively the intermediate medium may comprise an intermediate component, such as a heat transfer component configured to engage the target material so as to transfer heat from the heating device to the target material, typically using at least conduction.

The method may comprise initiating the heating device. The heating device may be initiated by an ignition of a combustible. The ignition may comprise a selectively controllable ignition. The ignition may be controlled by a signal, such as an electrical signal. The initiation of the heating device may bring the fuel of the heating device up to a temperature sufficient for the fuel to oxidize. The temperature may be sufficient for the heating device to break down the oxidizing agent to facilitate oxidation of the target material. The combustible and/or the heating device may heat the target material to a sufficient temperature to start oxidation of the target material, in the presence of a suitable oxidant. The sufficient temperature to start oxidation of the target material may be less than the melting temperature of the target material. The oxidizing target material may be heated to a sufficient temperature to break down the oxidizing agent to facilitate continuing oxidation of further target material. The method may comprise supplying oxygen to the heating device and/or the target material to propagate the oxidation.

The method may comprise oxidizing the downhole material in an exothermic reaction. The exothermic reaction may generate sufficient heat to heat additional target material sufficiently to propagate the oxidation process. The method may comprise continuing the oxidation process to further remove target material by oxidation. The method may comprise continuing oxidation until a sufficient amount of target material has been oxidized and/or removed. In at least some examples, the sufficient amount of target material to be oxidized and/or removed is predetermined. Alternatively, in at least some examples, the sufficient amount of target material to be oxidized and/or removed is actively determined, such as during the process.

The downhole material may comprise one or more of: a downhole well element; a casing; a liner; a tubular; a toolstring; a production tubing; a metal; a composite; a downhole assembly; a downhole apparatus; a shoe; a cement; a cement component/s such as sulphide mineral/s in aggregate; a formation material; a control line; chemical injection line; umbilical. In at least some examples, the downhole material to be removed comprises steel, such as a portion of a production tubing.

The method may comprise the successive oxidation of sequential layers of the downhole material, each layer being oxidized prior to its removal to reveal a next, underlying layer of downhole material for oxidation. The oxidized layers may be removed by a flow, such as a flow of one or more of: oxygen; oxidized material; fuel; oxidizing agent; carrier fluid; flushing fluid; injection fluid; and/or a mixture. The oxidized layers may be at least partially removed during oxidation. For example, a partially oxidized layer may become detached and further or fully oxidized subsequent to detachment. The oxidized layers may be from a same base target material, such as the downhole well element. In at least some examples, the oxidized material may be removed by an additional process or step, such as by a milling, drilling or other mechanical material removal process. The oxidation may improve, quicken or simplify the additional process or step, such as by enabling quicker and easier mechanical removal of the target material (e.g. compared to mechanical removal of non-oxidized target material).

The method may comprise a sequential removal of material, such as a sequential removal of tubulars. The tubulars may be arranged concentrically and/or longitudinally.

The method may comprise the removal of material at a plurality of locations, such as at a plurality of locations spaced longitudinally downhole. In at least some examples, the locations may be in one or more of: vertical borehole; horizontal borehole; deviated borehole; branch borehole.

The method may comprise predetermining an amount of fuel and/or oxidant required. The method may comprise providing an excess of fuel and/or oxidant, the excess being greater than an amount of fuel and/or oxidant required to remove a target amount of target material. The method may comprise terminating the oxidation process prior to exhaustion of the fuel and/or oxidant. For example, the method may comprise extinguishing the oxidation process by the cessation and/or interruption of the availability of the fuel and/or oxidant, such as by reducing or stopping supply thereof. The oxidation may comprise a rapid oxidation.

The method may comprise controlling the process. The method may comprise remotely controlling the process. Remote control may be from surface, such as via connection, communication; and/or supply of one or more of the fuel, oxygen, and/or oxidizing agent. The method may comprise controlling the initiation. The method may comprise controlling the initiation remotely. The method may comprise controlling the process post-initiation, such as controlling the further development or progress of the process following initiation. Controlling the process may comprise actively adapting the process, such as selecting when to initiate the process and/or when or how to vary a process parameter, particularly mid-process. The method may be selectively controlled. The method may be manually controlled, such as by an operator at surface. Additionally, or alternatively, the method may be automatically controlled. In at least some examples, the method may be at least partially automatically controlled. The method may comprise obtaining feedback, such as via real-time, live or other in-process monitoring of one or more parameters. The method may comprise adapting the process according to the feedback. The process parameter/s to be varied may be selected from one or more of: a supply of oxygen, a supply of oxidizing agent; a supply of fuel; a temperature; a fluid flow; a position, such as of the downhole assembly.

In at least some examples, the method may comprise removing material to create an axial discontinuity, such as by removing material circumferentially so as to provide a split in the downhole well element. The axial discontinuity may expose or eliminate one or more annuli, such as between the removed material and a bore wall, such as cased or lined borewall.

The method may comprise one or more processes subsequent to the material removal with the heating device. In at least some examples, the method may comprise a subsequent operation of preparing the target location, such as preparing adjacent formation and/or liner or casing. Preparing the target location may comprise perforating. In at least some examples, the method may comprise pulling the downhole assembly with the heating device prior to the perforating. In other examples, the method may comprise not pulling the downhole assembly with the heating device, such as with the heating device being left downhole permanently (e.g. if the heating device is fully consumed) or if the perforating equipment is run-in together with the heating device (e.g. on a perforating portion of a string comprising the downhole assembly with the heating device). In at least some examples, one or more perforating guns or assemblies may be run-in (e.g. from surface) or partially run-in (e.g. from an uphole location) after the heating device has been extinguished or fully consumed. The perforating equipment may perforate one or more of: tubular; casing; liner and/or formation. The previous material removal with the heating device may have exposed the portion/s to be perforated. The method may comprise an isolation operation subsequent to the material removal. For example, the method may comprise a plugging operation, such as for abandonment. The method may comprise providing a plug, such as a cement plug at the target location. The material removal may allow the cement to readily access a space, such as an annulus previously behind the removed material; and/or (lined) bore walls and optionally the formation (e.g. if unlined, or if a liner or casing has been perforated or removed). The method may comprise a cementing operation, pumping in cement to set to provide a barrier. The material removal may allow the plug to provide an absolute axial barrier. The material removal may remove a possible leakpath/s, such as along a downhole element, annulus or microannulus that may otherwise have been present prior to the material removal.

The method may comprise providing a permanent well barrier extending across the full cross-sectional area of the bore, including any annuli, sealing both vertically and horizontally. The method may comprise eliminating or at least reducing mechanical removal, such as by milling or drilling that may otherwise be required for plugging. The method may reduce or eliminate flushing operations, such as by eliminating or reducing swarf flushing that may otherwise be associated with other forms of material removal.

In at least some examples, the method may comprise one or more processes prior to the material removal with the heating device. In at least some examples, the method may comprise a prior operation of preparing the target location, such as preparing the bore at, above or below the target location. In at least some examples, the method may comprise a plugging operation prior to the material removal. For example, the method may comprise a prior isolation operation, such as for abandonment, typically below the target location. The method may comprise providing a plug, such as a cement plug below the target location. Additionally or alternatively the method may comprise providing a packer or plug to provide a temporary or permanent seal above and/or below the target location to prevent or reduce undesired flow during the oxidation process. For example, where the downhole well element to be oxidized is a tubular, the tubular may be plugged below the target location.

In at least some examples, the heating device may be consumed during oxidation axially along its length, typically upwardly from a downhole or lower end portion thereof. In other examples, the heating device fuel is consumed downwardly from an upper end portion. The axial length of the heating device consumed or to be consumed during oxidation may correspond, such as directly, to the axial length of the target material to be removed. The axial length of the target material to be removed may be selected from one metre, up to hundreds of metres, or even kilometres, depending upon the operation. In some methods, the target material may provide at least the main or predominant fuel source for the continued oxidation. For example, the downhole apparatus may provide fuel only sufficient to initiate the oxidation process or to initially heat the target material to a sufficient oxidation temperature. Once the target material has reached an oxidation temperature, the oxidation process may be continued or propagated by the supply of oxygen, such as by the continued supply of oxidant at the target location. In at least some examples, the downhole apparatus may require a non-consumable heat source, such as a heat source not requiring fuel per se. For example, the heat source may comprise an electric heat source. The heat source may comprise a re-usable heat source.

The downhole assembly may remain substantially stationary during the oxidation process. In at least some examples, the heating device may be consumed at a rate similar to, or slightly less, than the target material. For example, an expected axial rate of oxidation or removal of the target material may be predetermined (e.g. by calculation or simulation) such that the heating device may be configured to diminish (by oxidation) at a corresponding rate, optionally incorporating a margin for error or safety margin to ensure that all target material is removed along the axial length of the target material to be removed. In at least some examples, the rate of consumption of the heating device may be actively controlled.

In at least some examples, the method may comprise repositioning the downhole assembly during the oxidation process. For example, the method may comprise repositioning the heating device to accommodate a rate of material removal. Particularly where there is a difference between the axial rate of removal of material from the target material and the axial rate of consumption of the heating device, then the downhole assembly may be repositioned during the oxidation process to locate an oxidizing portion of the heating device relative to the target material (e.g. axially adjacent or within the target material).

The method may comprise a rigless operation. The method may be performed without requiring a workover or drilling rig. The method may comprise an intervention or downhole operation from a rigless mobile surface unit. For subsea bores, the method may comprise operation from a floating vessel.

Removal may comprise local removal. For example, the method may comprise locally removing material from the downhole well element, such as a downhole part, component, assembly, and/or location. In at least some examples, at least a portion of the locally removed material may remain downhole, such as to provide material for another purpose, such as for forming a plug, seal or barrier. In at least some examples, at least a portion of the locally removed material may be moved or displaced to another downhole location. In at least some examples, at least a portion of the locally removed material may be removed or extracted from the bore, such as by retrieval uphole. In at least some examples, at least a portion of the locally removed material may remain downhole whilst another portion of the locally-removed material is removed or extracted from the bore, such as by retrieval uphole.

The method may comprise weakening the target material for removal, such as from and/or within the bore. For example, the method may comprise mechanically weakening the target material by heating and/or oxidation and/or melting. The method may comprise at least partially removing the target material with gravity. In at least some examples, the method may comprise oxidising and/or melting the target material and locally removing the oxidized and/or melted target material under gravity. For example, particularly in a non-horizontal bore, target material may be oxidised and/or melted such that the target material drops down below the target location. The removed target material may be removed from the target location, such as by dropping below the target location. Accordingly, the target location may be made free of target material, such as to create a discontinuity or window or the like. The removed target material may be directed or guided away from the target location. For example, the target material may be funneled and/or flushed towards a particular deposition location in the bore, such as a sump so as to provide access to a window or discontinuity being created.

The method may comprise removing material from the bore. For example, the method may comprise removing material from the target location and/or there above. The method may comprise pulling non-oxidized material from the bore. For example, the method may comprise pulling a part of the downhole element not removed or oxidized by the heating device. In at least some examples, the method may comprise pulling downhole equipment and/or tubing and/or casing or liner. For example, the method may comprise extracting uphole tubing above the target location, the uphole tubing being freed or released by the material removal with the heating device.

The method may comprise partially pulling. For example, the method may comprise not entirely pulling from the bore, such as merely pulling far enough to allow a further operation. If, by way of example, a regulation or procedure requires a minimum length of seal within a bore, then the pulling may be based upon that minimum length (e.g. only pulling that minimum length or at least that length, such as with an additional margin for safety). Pulling that minimum length may provide a length of bore of sufficient length free from the pulled material. In other examples, the method may comprise complete pulling, such as to maximise recovery of material from the bore.

In at least some examples, the method may comprise removing only a portion of the downhole material, such as only a portion of the downhole well element. The method may comprise removing an axial portion and/or a circumferential portion. For example, the method may comprise removing a window portion, such as for access therethrough (e.g. to access a further casing, tubular or formation beyond the removed material).

In at least some examples, the method may comprise the removal of target material at a plurality of target locations. The method may comprise the removal or target material at a plurality of target locations in a single run. For example, the method may comprise the removal of target material from a first downhole target location, then repositioning the downhole assembly at a second downhole target location (e.g. by partially pulling the downhole assembly) and then removing target material at the second downhole target location. The method may comprise repositioning the downhole assembly without requiring a re-initiation of the heating device. In at least some examples, oxidation may continue uninterrupted whilst the downhole assembly is repositioned. Alternatively, the oxidation may be interrupted whilst the downhole assembly is repositioned, in at least some examples requiring a re-ignition of the heating device. The method may comprise an interruption in or reduction of the supply of fuel and/or oxidizing agent during the repositioning. Additionally, or alternatively, the downhole assembly may be repositioned at a sufficient rate so as not to substantially remove material between the first and second downhole target locations.

The method may comprise protecting at least one part or region with a shield. For example, the method may comprise providing a thermal shield downhole. The thermal shield may comprise a high temperature resistant element, such as comprising, by way of example, ceramic and/or glass. The method may comprise providing a plurality of shields. The method may comprise positioning the shield/s downhole prior to initiation. The shield/s may protect one or more zone/s, area/s or portion/s downhole so as to prevent heating and/or oxidation and/or material removal therefrom. In at least one example, shield/s protect a zone, area or portion uphole of the target material, such as a non-oxidizing portion of the downhole assembly and uphole equipment and/or materials associated with or attached thereto (e.g. coiled tubing, uphole casing, or the like associated with or attached to the downhole assembly). Additionally, or alternatively, the shield/s protect a zone, area or portion downhole of the target material, such as a seal, plug or packer located below the downhole assembly, typically below the target material. In at least some examples, the shield/s protect a non-window portion, that is a portion of the downhole part or component not intended to be removed, such as a portion of casing, liner or tubular surrounding a window portion to be removed. In at least some examples, the method may comprise a preparation for a sidetracking or secondary bore-drilling process.

According to a further aspect, there is provided an apparatus for the removal of material, such as according to the method of any other aspect, example, embodiment or claim.

According to a further aspect, there is provided a downhole apparatus for the removal of downhole material, such as according to the method of any other aspect, example, embodiment or claim.

The downhole apparatus may comprise an oxidizing apparatus for oxidizing the downhole material, such as to facilitate the removal of the downhole material. The apparatus may comprise a heat source; and/or a fuel supply; and/or an oxidant supply. The heat source may comprise a thermal or heating device. The heating device may comprise a fuel. The apparatus may comprise a container for at least one of fuel and/or oxidizing agent. The fuel and/or oxidizing agent may comprise any of the features of the respective fuel and/or oxidizing agent of any other aspect, embodiment, example or claim of this disclosure. The container may comprise an inlet; such as an inlet for connection to a pipe, conduit, coiled tubing, pump or injection system for supplying fuel and/or oxidizing agent into the container. The container may comprise a sheath. The housing may comprise a consumable, such as a fuel material. In at least some examples, the heating device comprises a sheath housing a plurality of metal components, such as steel and/or magnesium and/or aluminium fuel rods. The sheath may comprise a similar material to the fuel housed within. The sheath may be configured to be consumed at an axial rate similar to the fuel housed within. In at least some examples, the apparatus may comprise an inlet for receiving fuel to be supplied downhole, such as via a conduit from uphole (e.g. a surface source). The apparatus may comprise one or more valves for controlling the supply of fuel and/or oxidant to and/or from the downhole apparatus. In at least some examples the apparatus may comprise a controller for controlling the supply of fuel and/or oxidant to and/or from the downhole apparatus. The controller may be located downhole.

The downhole apparatus may be connected uphole, such as to surface. For example, the downhole apparatus may comprise a connection to coiled tubing, wireline, slickline, tubular or the like.

The apparatus may comprise an initiator for initiating the heating device. The initiator may comprise a charge. The initiator may be comprised in an ignition head.

The downhole apparatus may comprise a shield, such as a thermal shield. The downhole apparatus may comprise a plurality of downhole shields. The shield may comprise one or more of: a solid, a liquid; a powder; a gel; a fixed form; a flexible form; an adaptive form. The shield may comprise a defined form. Additionally or alternatively the thermal shield may comprise an indefinite form. For example, the shield may comprise a flowable material, such as of a particulate and/or fluid material.

The downhole apparatus may be configured to oxidize and/or remove target material from a target downhole location. The apparatus may comprise a predetermined amount of fuel and/or oxidant. In at least some examples, the heating device may be configured to be consumed at a rate similar to, or slightly less, than the target material. For example, an expected axial rate of oxidation or removal of the target material may be predetermined (e.g. by calculation or simulation) such that the heating device may be configured to diminish (by oxidation) at a corresponding rate, optionally incorporating a margin for error or safety margin to ensure that all target material is removed along the axial length of the target material to be removed. In at least some examples, the apparatus may be configured to control the rate of consumption of the thermic lance or other heating member.

An example method comprises the steps of;

providing an amount of the fuel and oxidizing agent such as oxygen, the type, geometry and amount of both being adapted to perform the desired operation, positioning the fuel and oxidizer mixture at a desired position in the well, such as the target location; and initiating the chemical reaction, thereby oxidizing surrounding materials in the well.

According to a further aspect there is provided an apparatus for removing material. The apparatus may comprise a well apparatus for removing material at a well. For example, the well apparatus may be for removing material downhole; and/or for removing material at surface, such as for removing material from a surface apparatus or installation. The apparatus may comprise a heat source; and/or a fuel supply; and/or an oxidant supply. The heat source may comprise a thermal or heating device. The heating device may comprise a fuel. The apparatus may comprise a heating device for the oxidation and/or heating of a target material.

The apparatus may be for removing at least a portion of the target material. The target material may be or may be located in an enclosed volume, such as a passage. In at least some examples the target material may at least partially define the enclosed volume, such as comprising at least a portion of a wall of the enclosed volume. The enclosed volume may be partially enclosed, such as with one or more openings or unenclosed portions. Alternatively, the enclosed volume may be entirely enclosed.

The heating device may comprise a combustible fuel. The heating device may comprise a thermic lance. The heating device may comprise a heating member. The heating member may comprise a self-consuming heating member. The heating member may be configured to be consumed during heating. The heating member may comprise the thermic lance. The heating member may comprise a container for at least one of fuel and/or oxidizing agent. The fuel and/or oxidizing agent may comprise any of the features of the respective fuel and/or oxidizing agent of any other aspect, embodiment, example or claim of this disclosure. The container may comprise an inlet; such as an inlet for connection to a pipe, conduit, coiled tubing, pump or injection system for supplying fuel and/or oxidizing agent into the container. The container may comprise a sheath. The housing may comprise a consumable, such as a fuel material. In at least some examples, the heating device may comprise a sheath housing a plurality of metal components, such as steel and/or magnesium and/or aluminium fuel rods. The sheath may comprise a similar material to the fuel housed within. The sheath may be configured to be consumed at an axial rate similar to the fuel housed within.

The heating device may comprise a longitudinal extent. The longitudinal extent may extend in an axial direction along the enclosed volume when the apparatus is in use. The heating device may comprise a longitudinally extending heating member. The heating device may be configured to heat along the axial extent. In at least some examples, the heating device is configured to heat progressively along the axial extent, such as by progressive heating longitudinally along the heating member.

The heating device may be configured to oxidise and/or heat transversely, such as transversely to a longitudinal axis of the apparatus and/or the passage. The apparatus may be configured to oxidise and/or heat laterally. The apparatus may be configured to direct heat and/or oxygen and/or fuel transversely. In at least some examples, the heating device may be configured to direct heat substantially tangentially, such as when viewed axially (e.g. with a tangential component or vector).

The heating device may comprise a circumferential or at least partial circumferential extent, such as when viewed axially (e.g. when viewed along the longitudinal axis). The heating device may comprise a heating member that is configured to direct heat sequentially or temporally in an angular direction, such as radially or laterally relative to the longitudinal axis. For example, the heating member may be configured to progressively direct heat around the longitudinal axis, such as at least 360 degrees around the longitudinal axis. In at least some examples, the heating member may be configured to direct heat progressively in multiple revolutions around the longitudinal axis. Accordingly, in such examples the heating member may heat around the entire longitudinal axis, such as progressively or sequentially around an entire circumference of the longitudinal axis.

The heating member may be for progressively jetting heat along a helical path to heat the target material for removal. The heating member may be configured to jet heat along the helical path. In at least some examples, the heating member may comprise a least a portion that is helical or spiral. The heating member may comprise a helical heating member. The helical or spiral portion may comprise a regular helix or regular spiral, such as a conical or a cylindrical helix or spiral. The helix may comprise a left or a right hand helix. The helix may comprise one or more revolutions. The helix may comprise a helix angle, the helix angle being defined as the angle between the helix and an axial line on the helix's right, circular cylinder or cone. The helix may comprise a helix pitch, the pitch being the height of one complete revolution, measured parallel to the longitudinal axis of the helix.

The heating member may comprise a member cross-section, such as a circular member cross-section. Particularly where the heating member comprises a thermic lance, an outline of the cross-section may be defined by the container or sheath of the thermic lance. In at least some examples, the cross-section may be continuous along the heating member, such as along the helical length of the heating member. The cross-section may comprise a non-solid or a hollow profile, such as with one or more openings therein (e.g. extending along at least a portion of the length of the heating member). The heating member cross-section may comprise one or more properties, such as a total cross-sectional area; a cross-sectional profile area; and/or a cross-sectional diameter (e.g. where the cross-section is circular).

The heating member may comprise a longitudinal length, such as a separation between opposite ends of the heating member in a longitudinal direction. The heating member may comprise a total heating member length. Particularly where the heating member comprises a helix, the heating member length may be considerably longer than the longitudinal length of the heating member. For example, where the helical heating member length can be considered as unraveled or unwound, such heating member length may be considerably longer than the longitudinal separation between the opposite ends of the heating member is in its helix.

The helical heating member may comprise a longitudinal separation between adjacent revolutions or turns of the helix. For example, the helical heating member may comprise no more than a maximum longitudinal separation between adjacent revolutions or turns of the helix, such that there is no longitudinal separation between corresponding revolutions or turns of target material that is not sufficiently heated and/or oxidised. Accordingly the apparatus may be configured to remove a tube or cylindrical shaped volume of target material.

Alternatively, in some examples, the longitudinal separation between adjacent revolutions or turns of the helix may exceed the maximum longitudinal separation, such that a corresponding portion of the target material (e.g. a corresponding helical portion of the target material) may be insufficiently heated and/or oxidised—for example, to leave the corresponding portion of the target material, or leave the corresponding portion of target material less- or un-treated. In such examples, the apparatus may be configured to heat and/or remove a helical portion of target material (e.g. only a helical portion). Accordingly the apparatus may be configured to remove a helical-form portion of target material. The apparatus may be configured to remove a helical-form portion of target material such as to leave a corresponding helical-form portion of target material unremoved, the corresponding portion being arranged between the helical turns of the removed portion.

The longitudinal separation between adjacent revolutions or turns of the helix may be determined by or at least related to the pitch and/or the cross-sectional property of the heating member. For example, the pitch of the helix may be the sum of the longitudinal separation between adjacent revolutions or turns and an outer diameter of the cross-section of the heating member.

The helix may comprise a helix diameter. The helix may comprise an inner diameter. The helix may comprise an outer diameter. The inner and/or outer diameter/s may be defined when viewed axially, such as by a circle/s or a portion/s of circle/s in a plane perpendicular to the longitudinal axis along which the helix extends. The helix outer diameter may be selected according to an intended use, such as a minimum inner diameter of a target material into which the heating member is intended for insertion. The helix inner diameter may be selected according to an intended use, such as an intended central passageway defined by an inner cylindrical volume within the inner diameter of the helix. The inner and outer diameters of the helix may be determined by or related to the heating member cross-sectional property/ies, such as the heating member cross-sectional diameter. For example, the outer helix diameter may be greater than the helix inner diameter by an amount defined by the heating member cross-sectional diameter.

At least one or more of the following may be predetermined according to intended use: longitudinal separation between adjacent revolutions or turns; heating member cross-section property/ies; helix pitch; helix diameter; heating member longitudinal length; helix angle. For example, each of the helix pitch; helix diameter; heating member longitudinal length; helix angle and heating member cross-section property/ies may be selected according to the portion of target material to be heated and/or removed. In at least some examples, the helix diameter is selected to be less than a minimum inner diameter of the target material to be heated and/or removed. For example, where the helical heating member is for heating a portion of a passage, such as a portion of a downhole wellbore, the helix outer diameter may be selected to be less than a minimum diameter of a restriction, such as an inner diameter of a flow control device or flange, through which the heating member must pass to reach the target material.

The heating member may comprise an expandable heating member. For example, the heating member may comprise a helical member that is radially and/or longitudinally expandable. In at least some examples, the heating member is transferable to the target location in a collapsed configuration for expansion at the target location. Particularly where the heating member is a helical heating member for target material heating and/or removal within or of the enclosed volume, the heating member may be transported to the target location in the collapsed configuration to allow or simplify the passage of the heating member thereto, such as through one or more restrictions. For example, where the target material to be heated and/or removed is or is in a passage, such as in a well bore or being a well apparatus, the heating device may be transportable to the target location in the passage with the heating member radially collapsed so as to ease transport through a narrow diameter passage.

In at least some examples, the heating member may be radially and/or longitudinally expandable by an active or forced expansion by an expander. For example, the apparatus may comprise an expansion cone for axial passage through the helical heating member so as to increase the inner diameter of the helix, thereby increasing the outer diameter of the helix. The heating member may be selectively expandable, such as upon selected actuation of the expander.

Additionally or alternatively, the heating member may be radially and/or longitudinally expandable according to a spring property of the heating member. For example, the helical heating member may be transported in a collapsed configuration, with the heating member radially and/or longitudinally constrained. The radial and/or longitudinal constraint may be achieved by an apparatus member, such as an apparatus sheath and/or apparatus piston. Alternatively, the constraint may be external to the apparatus, such as defined by the enclosed volume into or through which the heating member is to pass. For example, the helical heating member for downhole well material heating and/or removal may be collapsed at surface to radially fit within a casing or tubular, with the casing or tubular constraining the outer diameter of the helix. The helical member may then be transported downhole to the target location, the target location including a larger diameter, or acquiring a larger diameter during material removal, so as to allow or trigger expansion of the heating member to a larger outer helix diameter. The heating member may be expandable before and/or during and/or after a heating. For example, the heating member may be expandable after a first heating, being expanded to a greater diameter for a second heating.

In at least some examples, the heating member may be longitudinally and/or radially expandable by an application of tension or compression to the heating member. For example, the heating member may be selectively subjected to a tensile longitudinal force (e.g. by pulling on one or both ends) so as to longitudinally stretch the heating member, optionally thereby radially collapsing the heating member. Particularly where the heating member comprises the helix, the property/ies of the helix may be adjustable, such as selectively adjustable. For example, the helix pitch may be adjustable with the application of longitudinal tension to the heating member.

Additionally, or alternatively, the heating member may comprise a collapsible heating member. For example, the heating member may be radially collapsible to a smaller diameter, such as for passage or subsequent passage through a restriction prior to a heating. The heating member may be collapsible by the passage of a member, such as a sheath, along the outer diameter of the heating member.

In at least some examples, the apparatus may comprise an inlet for receiving fuel and/or oxidant to be supplied, such as via a conduit or passage (e.g. from a remote source). The apparatus may comprise one or more valves for controlling the supply of fuel and/or oxidant to and/or from the heating member. In at least some examples the apparatus may comprise a controller for controlling the supply of fuel and/or oxidant to and/or from the heating member. In at least some examples, the heating device may comprise the valve/s and/or the controller.

The apparatus may comprise an ignition. The ignition may comprise an electric ignition. The ignition may be remotely controllable.

The heating device may comprise a central passage, such as located radially inwards of the heating member. For example, where the heating member comprises the helix, the central passage may be located in or defined by the helix inner diameter. In at least some examples, the central passage may include the central longitudinal axis of the heating device. The central passage may be parallel to; and optionally collinear with; the central longitudinal axis of the heating device. In at least some examples, the central passage may comprise a central member. The central member may comprise a hollow central member. In at least some examples, the central member may comprise an enclosed hollow central member defining a bore or throughbore therewithin. The central passage may be configured for the transmission of signals and/or materials therethrough. For example, the central passage may be configured for the transmission of signals and/or materials, such as fuel, to one or more heating devices. The signal/s may comprise one or more of: an actuation signal/s; a control signal/s; a measurement signal/s. For example the signals may comprise the incoming actuation and the deactuation signals for the heating device and a further heating device; and an outgoing measurement signal indicative of the heating process, such as to indicate a temperature and/or a material removal status. The central passage may comprise one or more of: an electrical line/s; a fluid line/s; a fibreoptic line; an acoustic transmission line; an electromagnetic transmission line. The central passage may be configured to protect from heat. For example, where the apparatus is configured to direct heat laterally outwards, the central passage located centrally, at an inner diameter, may be configured to inherently receive less heat, relative to radially outside the heating member. The central passage may be thermally shielded, such as by the central member comprising a cylindrical thermal shield.

The apparatus may be configured to provide an oxidizing agent, such as from an uphole location (e.g. from a surface source or container uphole of the heating device). The central passage may provide a supply passage for the oxidizing agent.

The apparatus may comprise a plurality of heating members. The heating device may comprise the plurality of heating members. For example, the apparatus may comprise two, three or four heating members, as selected. Each of the heating members may be arranged at a similar longitudinal position.

The plurality of heating members may be configured to heat and/or oxidise a same portion of target material. The same portion of target material may be located at the same target location. Each of the heating members may be configured to remove a helical-form portion of target material, each helical form portion rotationally spaced. Each of the heating members may be configured to remove a helical-form portion of target material such as to remove a tube-shaped or cylindrical volume of target material. The plurality of heating members may be configured for substantially simultaneous actuation. Actuation may comprise ignition. The plurality of heating members may be configured for simultaneous heating. The plurality of heating members may be configured to concurrently heat. The plurality of heating members may be singularly controllable, such as via a single controller for controlling the plurality of heating members. The plurality of heating members may be configured for simultaneous oxygen and/or fuel supply, such as from a single oxygen source and/or a single fuel source. The plurality of heating members may be configured for substantially simultaneous deactuation. Deactuation may comprise extinction, such as by cessation of the oxygen supply.

The respective heating members may be configured to heat different portions of target material. The different portions may be concentrically arranged. For example, a first heating member may be configured to remove an inner portion of target material and a second heating member may be configured to remove an outer portion of target material.

Two or more of the heating members may comprise one or more similar properties. For example two or more of the heating members may comprise similar helical heating members, comprising similar: helix pitch; heating member longitudinal length; helix angle and/or heating member cross-section property/ies. In at least some examples, the plurality of helical heating members have similar properties, arranged longitudinally coincident, with the helical heating members rotationally offset, such that the two or more helical heating members are arranged circumferentially around the plane perpendicular to the longitudinal axis. The helical heating members may be evenly rotationally offset. For example, where there are two longitudinally coincident similar helical heating members, the helical heating members may be arranged rotationally offset by 180 degrees.

The apparatus may comprise a plurality of heating devices. For example, the apparatus may comprise a plurality of heating devices spaced longitudinally, such as along a longitudinal axis of a downhole tool string. Each of the plurality of heating devices may be similar. For example, each of the plurality of heating devices may comprise a similar number of heating members. In at least one example, each of the plurality of heating devices comprises a single helical heating member. Alternatively, at least one of the heating devices may be dissimilar. For example, at least one of the heating devices may comprise a dissimilar number of heating members.

The plurality of heating devices may be selectively controllable. Each of the heating devices may be independently controllable. For example, a supply of fuel and/or oxidant to a first heating device may be controlled separately from a supply of fuel and/or oxidant to a second heating device. Additionally or alternatively, the control of at least some of the plurality of heating devices may be linked and/or synchronised.

The plurality of heating devices may be selectively actuatable. Each of the heating devices may be independently actuatable. For example a first heating device may be actuated prior to a second heating device. Additionally or alternatively, the actuation of at least some of the plurality of heating devices may be linked and/or synchronised.

According to a further aspect, there is provided a method of heating. The method may comprise removing material. The method may comprise heating and/or removing material at a well. For example, the method may be for removing material downhole; and/or for removing material at surface, such as for removing material from a surface well apparatus or installation. The method may comprise heating a target material with a heating device comprising a helical thermic lance.

According to a further aspect there is provided a method of manufacturing a thermic lance, the method comprising forming the thermic lance into a helix or spiral. The method may comprise winding a heating member of the thermic lance into a helix, such as around a drum or mandrel. The method may comprise cylindrically and/or conically winding the heating member such as to form a cylindrical and/or conical helical thermic lance.

According to a further aspect, there is provided a method of downhole oxidation. The method may comprise any of the features of any other aspect, example, embodiment or claim.

According to a further aspect, there is provided a downhole apparatus for the oxidation of downhole material, such as according to the method of any other aspect, example, embodiment or claim.

According to a further aspect there is provided a method of manufacturing the device or apparatus of any other aspect, example, embodiment or claim. The method may comprise additive or 3D printing. The method may comprise transferring manufacturing instructions, such as to or from a computer (e.g. via internet, e-mail, file transfer, web or the like).

According to a further aspect there is provided a method of oxidation. The method may comprise any of the features of any other aspect, example, embodiment or claim.

According to a further aspect, there is provided a method of heating. The method may comprise any of the features of any other aspect, example, embodiment or claim.

According to a further aspect, there is provided a method of material removal. The method may comprise any of the features of any other aspect, example, embodiment or claim. In at least some examples, the apparatus may comprise the features of a downhole apparatus of any other aspect, example, embodiment or claim, wherein those features are not limited to downhole. For example, the target material may comprise non-downhole target material, such as in or forming a passage in a different environment.

According to a further aspect, there is provided an apparatus for oxidation. The apparatus may comprise any of the features of any other aspect, example, embodiment or claim.

According to a further aspect, there is provided an apparatus for heating. The apparatus may comprise any of the features of any other aspect, example, embodiment or claim.

According to a further aspect, there is provided an apparatus for material removal. The apparatus may comprise any of the features of any other aspect, example, embodiment or claim.

According to a further aspect, there is provided a method, the method comprising determining at least one characteristic of a fuel and/or oxidizing agent and/or application thereof based upon a computer model.

Another aspect of the present disclosure provides a computer program comprising instructions arranged, when executed, to implement a method in accordance with any other aspect, example or embodiment. A further aspect provides machine-readable storage storing such a program.

The invention includes one or more corresponding aspects, embodiments or features in isolation or in various combinations whether or not specifically stated (including claimed) in that combination or in isolation. For example, it will readily be appreciated that features recited as optional with respect to the first aspect may be additionally applicable with respect to the other aspects without the need to explicitly and unnecessarily list those various combinations and permutations here (e.g. the apparatus or device of one aspect may comprise features of any other aspect). In particular, features recited with respect to the thermic lance may be applicable to other heating members, such as not per se helical or thermic lance heating members. For example, a heating member, or an outlet or nozzle thereof, may rotate and move axially to jet heat along the helical path. Similarly, features recited with respect to the helical heating member or helical thermic lance may be applicable to the helical path. For example, the helix properties, such as pitch, number of turns, helix angle, may be applicable to the helical path. Optional features as recited in respect of a method may be additionally applicable to an apparatus or device; and vice versa. For example, the apparatus may be configured or adapted to perform any of the method steps or features.

In addition, corresponding means for performing one or more of the discussed functions are also within the present disclosure.

It will be appreciated that one or more embodiments/aspects may be useful in removing downhole material, such as for abandonment of a bore.

The above summary is intended to be merely exemplary and non-limiting.

Various respective aspects and features of the present disclosure are defined in the appended claims.

It may be an aim of certain embodiments of the present disclosure to solve, mitigate or obviate, at least partly, at least one of the problems and/or disadvantages associated with the prior art. Certain embodiments may aim to provide at least one of the advantages described herein.

BRIEF DESCRIPTION OF THE DRAWINGS

These and other aspects of the present invention will now be described, by way of example only, with reference to the accompanying drawings, in which.

DETAILED DESCRIPTION

Figure 1:
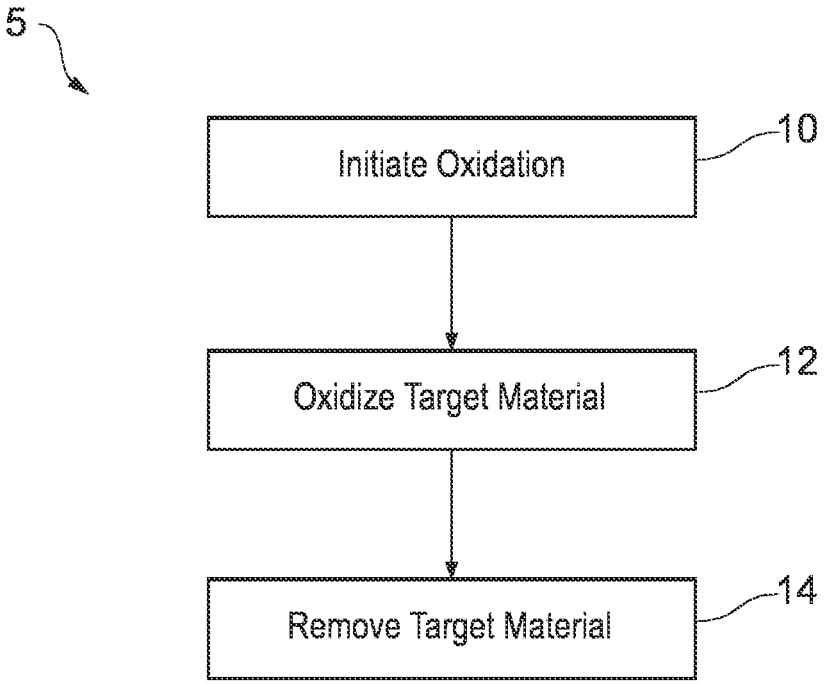
FIG. 1 is a flow chart of a method in accordance with a first example.

Referring first to FIG. 1, there is shown a flow chart depicting an example of a method 5 according to the present disclosure. The method 5 comprises a first step 10 of initiating oxidation; followed by a subsequent step 12 of oxidizing target material and a further step 14 of removing the oxidized target material.

Here, the method 5 comprises downhole material removal from a downhole well element, the method comprising running in a downhole assembly with a downhole heating device comprising a fuel to or towards a target location. The method 5 comprises providing an oxidant at the target location; and oxidizing a target downhole material at a target downhole location to facilitate the removal of the target downhole material. In this method 5, the oxidized target downhole material is removed.

In particular examples, the applicant has developed an alternative method for the removal of wellbore tubulars, using a rapid oxidation process to significantly alter the physical state of the tubular well element and reduce it to an oxide deviate thereby facilitating an area where, for example, a more conventional barrier can be installed in the wellbore.

The rapid oxidation process of the tubular element occurs with the addition of a fuel, typically steel rods and an oxidizing agent such as oxygen. The process utilizes an initiator to initially raise the temperature to start the process off during which the fuel rapidly oxides in the presence of the oxygen, releasing heat as part of the highly exothermic reaction. In so doing the target material, such as the well bore tubular element, temperature raises and reaches a point whereby it also undergoes the same rapid oxidation process and is also oxidized. The resultant by-product of the reaction, metal oxide, can be then easily be removed, such as by conventional well techniques if necessary.

After ignition, the introduced fuel and oxidizing agent will ignite, the reaction is exothermic in nature developing very high temperatures as part of the rapid oxidation process. The heat raises the surrounding target well element tubular temperature such that, in the presence of the introduced oxidizing agent, it will induce the well element to also undergo rapid oxidation.

The reaction process is controlled by the control and supply of the oxidizing agent. The process can be regulated and stopped by the cessation of supply of the oxidizing agent, so enabling precise targeting of specific lengths and geometry of well bore tubular elements to be oxidized and so removed. After the reaction is complete the residual metal oxide can be removed from the well bore by conventional means.

The method may further comprise the step of arranging an igniting head in connection with the fuel and oxidizing agent. The igniting head may be suitable for igniting the fuel and oxidizing agent.

In some embodiments the method comprises the step of positioning at least one high temperature resistant element close to the target position in the well. The high temperature resistant element serves to protect parts of the well or well elements that lies above, below and/or contiguous to the target position. The high temperature resistant element may be made of high temperature resistant materials such as a ceramic element or a glass element. There may be arranged one or more high temperature resistant elements in the well.

In at least some embodiments, the method comprises the steps of positioning the fuel material element in a container and lowering the container to the target position in the well by the use of coiled tubing or jointed pipe. Other methods can additionally or alternatively include positioning by wireline, slickline, cable or the like.

The desired amount of fuel is prepared at the surface and positioned in a container. The fuel will typically consist of steel rods. The container may be any container suitable for lowering into a well. Dependent on the desired operation, the container, or a set of a number of containers, may be a short or a long container. In a P&A operation, where the need of a large section of target tubular element to be removed is desired, the set of container may be several meters, ranging from 1 meter to 1000 meters.

In some embodiments, the method comprises the step of circulating the oxidizing agent material to the fuel in the container that has been positioned at the target tubular element position in the well. The oxidizing agent may be brought from the surface to the fuel position in the container in the well by circulation through coiled tubing or jointed pipe. The coiled tubing or jointed pipe may support the heating device and/or the container. Alternatively, the coiled tubing or jointed pipe may be discrete from the heating device and/or the container, such as where the heating device and/or container is located within the jointed pipe.

In some embodiments, the invention relates to the use of a fuel and oxidizing mixture for the removal of well bore tubular elements by rapid oxidation of the target well bore tubular element, which may be a key process step in the overall abandonment of a well.

Referring now to FIGS. 2, 3, 4, 5 and 6, there is shown sequentially a method of plugging a well for abandonment, the method comprising the oxidization and removal of target downhole material.

Figure 2:
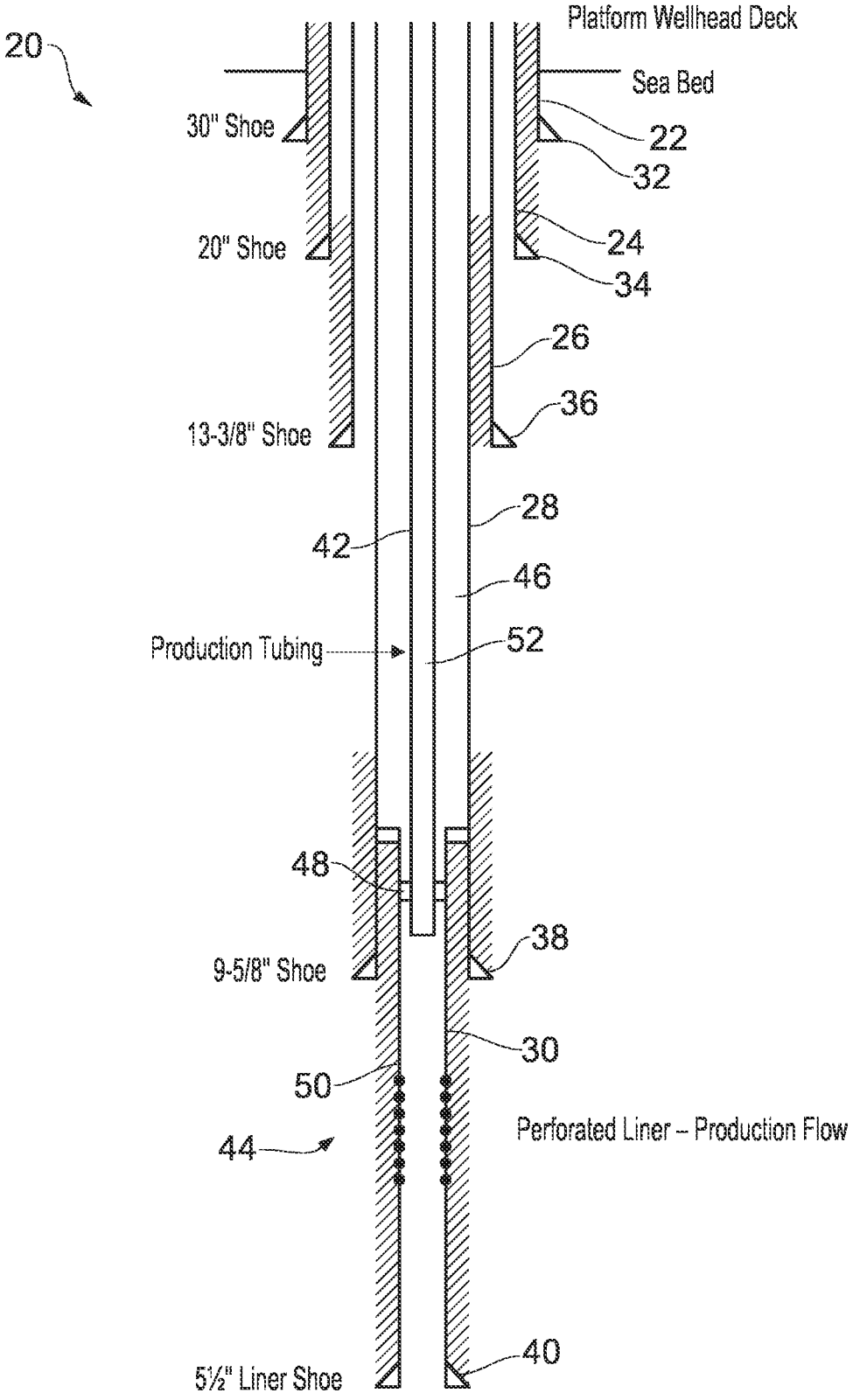
FIG. 2 is a schematic sectional side view of a portion of a well bore in accordance with a first example.

FIG. 2 shows a schematic sectional side view of a portion of a well bore 20 in accordance with a first example. Here the well bore 20 comprises a series of successively narrower sections of casing or liner 22, 24, 26, 28, 30 extending from a platform wellhead deck towards a subsea well. The respective casings 22, 24, 26, 28, 30 terminate with a respective shoe 32, 34, 36, 38, 40 with each casing 22, 24, 26, 28, 30 having been cemented in place. The well bore 20 shown in FIG. 2 is a completed production well bore with a production tubing 42 accessing a production fluid zone 44 axially sealed from a first annulus by a packer 48. Here the production fluid zone 44 comprises a perforated liner 50 allowing flow from (and to) the surrounding formation. Although shown here in FIG. 2 relative to a platform well, it will be appreciated that other examples may be for other bores, such as subsea wells and/or onshore wells.

Figure 3:
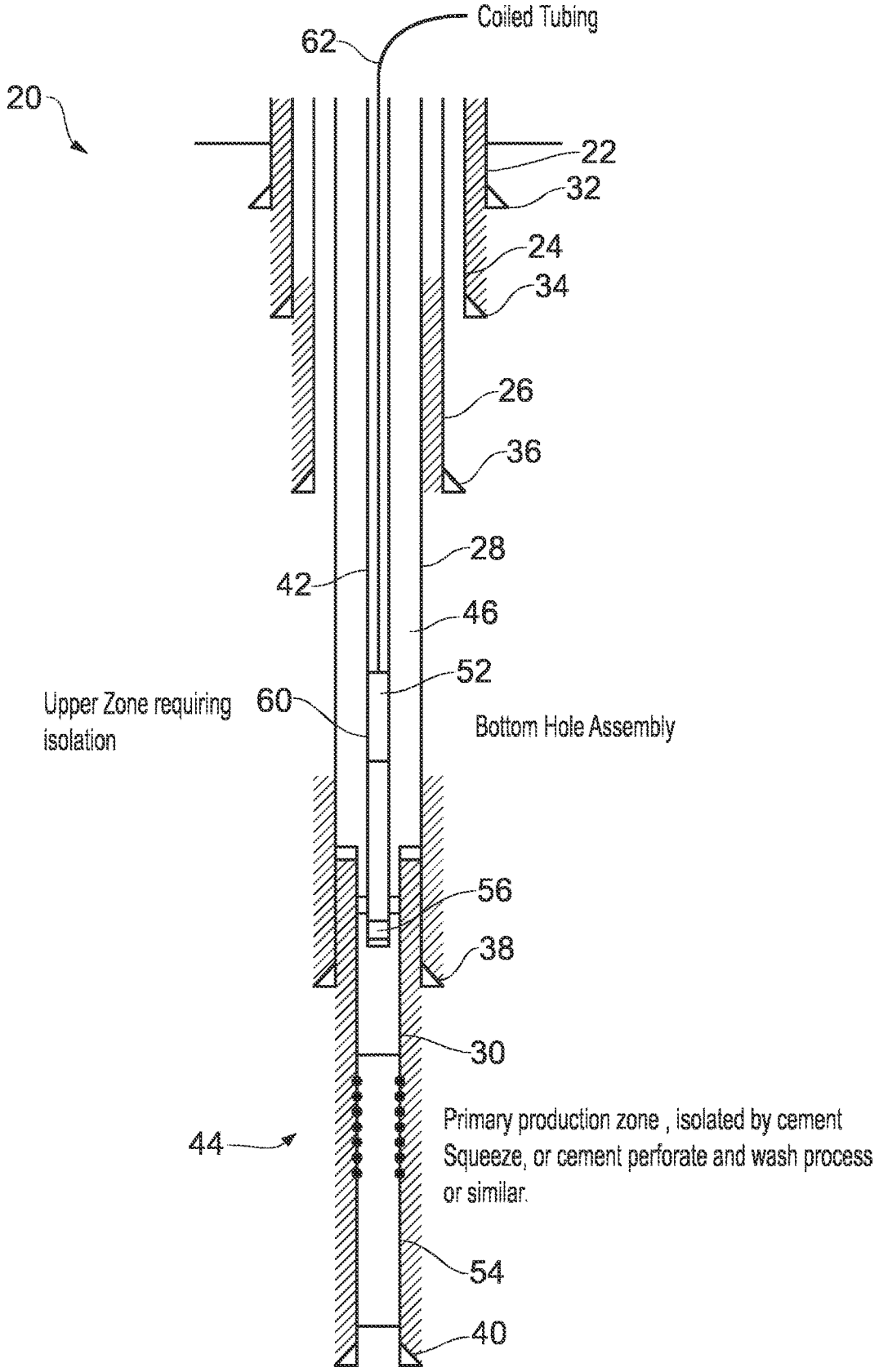
FIG. 3 is a subsequent view of the portion of the well bore of FIG. 2.

Referring now to FIG. 3, there is shown the well bore 20 of FIG. 2 following processes prior to the material removal with a heating device. As can be seen here, the method comprises a prior operation of preparing the target location 52, involving a plugging operation prior to the material removal. As can be seen in FIG. 3, the method comprises a prior isolation operation by providing a cement plug 54 below the target location 52 to seal the perforated liner 50 in the production fluid zone 44. In addition, the method comprises providing a plug 56 to provide at least a temporary seal below the target location 52 to prevent or reduce undesired flow during the oxidation process. It will be appreciated that the plug 56 can provide support for the cement plug 54 on top; and, can provide a temporary barrier below the cement plug 54. As shown in FIG. 3, the downhole well element to be oxidized here is the production tubing 42, which forms the target material in this example.

As shown in FIG. 3, there is provided a downhole apparatus 60 for the removal of downhole material. Here, the downhole apparatus 60 comprises a thermal or heating device, the heating device comprising a container for fuel and oxidizing agent. Here, the container comprises an inlet for connection to the coiled tubing 62, on which the downhole apparatus 60 has been run in to the target location 52. In at least some examples, the housing comprises a consumable sheath of a similar fuel material to steel and/or aluminium fuel rods housed therewithin. In at least some examples, the apparatus 60 comprises one or more valves for controlling the supply of oxidant to the downhole apparatus via the coiled tubing 62. In at least some examples the apparatus 60 comprises a controller for controlling the supply of fuel and/or oxidant to and/or from the downhole apparatus 60. Here, the downhole apparatus 60 is connected uphole to surface via the coiled tubing 62. Here, the apparatus 60 comprises an initiator for initiating the heating device with an ignition head comprising a charge. Although not shown in FIG. 3, in some examples the downhole apparatus 60 comprises a shield, such as a thermal shield.

Once the downhole apparatus 60 has been run in to the target location 52, as shown in FIG. 3, the method comprises the targeted oxidation of the target downhole material 42 at the target location. The heating device of the downhole assembly 60 directly and indirectly heats the target material 42 to be removed at the target location 52. Here, the method comprises initiating the heating device by the ignition of the combustible charge, bringing the fuel of the heating device up to a temperature sufficient for the fuel to oxidize. The temperature is sufficient for the heating device to break down the oxidizing agent to facilitate oxidation of the target material 42. The heating device heats the target material 42 to a sufficient temperature to start oxidation of the target material 42, in the presence of the suitable oxidant. The oxidizing target material 42 is heated to a sufficient temperature to break down the oxidizing agent to facilitate continuing oxidation of further target material 42. The method comprises supplying oxygen to the heating device and the target material 42 to propagate the oxidation.

The method may comprise directing a stream of pure oxygen at a red-hot area of the target material 42, so as to immediately form a film of oxide (e.g. iron oxide). Where the target material 42 is a steel tubing, the melting point of iron oxide (approx. 800-900 degrees C.) is well below the melting point of steel (1,400-1,500 degrees C.). The velocity of the stream of high pressure oxygen blows the oxide film away and another film of oxide is instantly formed and blown away. The intense heat generated at the end of the heating device, when applied to a material will quickly burn through it; and also consume the heating device. In at least some examples, the heating device is a thermic lance. The heating device may operate at a temperature in the order of 4,000 degrees C. The heating device may comprise an appropriate diameter for location within and thermal engagement with the target material 42. For example, the heating device may comprise a diameter from less than one inch, up to several inches. The diameter of the heating device may be selected according to an inner diameter at the target location 52, such as to provide a particular clearance between an outer diameter of the heating device and an inner diameter of the target material 42.

The method comprises oxidizing the downhole material 42 in an exothermic reaction. The oxidation comprises a rapid oxidation. Here the method comprises supplying the oxidizing agent from a surface source via the coiled tubing 62. The exothermic reaction generates sufficient heat to heat additional target material 42 sufficiently to propagate the oxidation process. The method comprises continuing the oxidation process to further remove target material 42 by oxidation. The method comprises continuing oxidation until a sufficient amount of target material 42 has been oxidized and removed (see FIG. 4). Here, the sufficient amount of target material 42 to be oxidized and removed is predetermined to provide an appropriate axial length of removed production tubing 42.

The downhole apparatus 60 is configured to oxidize and remove target material from the target downhole location 52. Here, the apparatus 60 comprises a predetermined amount of fuel. The heating device is configured to be consumed at a rate slightly less than the target material 42. Here, an expected axial rate of oxidation of the target material 42 has been predetermined (e.g. by calculation or simulation) such that the heating device is configured to diminish by oxidation at a corresponding rate, incorporating a safety margin to ensure that all target material 42 is removed along the desired axial length of the target material 42 to be removed. Furthermore, the apparatus is configured to control the rate of consumption of the heating device by controlling the supply of the oxidizing agent via the coiled tubing 62. As shown in FIG. 3, the downhole assembly 60 remains substantially stationary during the oxidation process. Here, the heating device is consumed during oxidation axially along its length, typically upwardly from a downhole or lower end portion thereof. In other examples, the heating device fuel is consumed downwardly from an upper end portion. The axial length of the thermic length consumed or to be consumed during oxidation corresponds directly to the axial length of the target material to be removed. The axial length of the target material to be removed is selected from one metre, up to hundreds of metres, or even kilometres, depending upon the operation.

In other examples, the method comprises repositioning the downhole assembly 60 during the oxidation process. For example, the method comprises repositioning the heating device to accommodate a rate of material removal. Particularly where there is a difference between the axial rate of removal of material from the target material 42 and the axial rate of consumption of the heating device, then the downhole assembly 60 is repositioned during the oxidation process to locate an oxidizing portion of the heating device relative to the target material 42 (e.g. axially adjacent or within the target material 42).

Here, the method comprises the successive oxidation of sequential layers of the downhole material 42, each layer being oxidized prior to its removal to reveal a next, underlying layer of downhole material 42 for oxidation. The oxidized layers are removed by a flow, such as a flow of one or more of: oxygen; oxidized material; fuel; oxidizing agent; carrier fluid; flushing fluid; injection fluid; acid and/or a mixture. In other examples, the oxidized material is removed by an additional process or step, such as by a mechanical removal process (e.g. a milling, drilling or other mechanical material removal process, or perforating or the like); and/or a chemical or fluid process (e.g. flushing with an acid or the like). The oxidation improves, quickens or simplifies the additional process or step, such as by enabling quicker and easier mechanical and/or chemical removal of the target material (e.g. compared to mechanical and/or chemical removal of non-oxidized target material).

The method comprises predetermining an amount of fuel required. Here, the method comprises providing an excess of fuel, the excess being greater than an amount of fuel required to remove a target amount of target material 42. The method comprises terminating the oxidation process prior to exhaustion of the fuel. For example, the method comprises extinguishing the oxidation process by the cessation of the availability of the oxidant, such as by reducing or stopping supply via the coiled tubing 62.

The method comprises remotely controlling the process from surface by controlling the supply of oxidizing agent via the coiled tubing 62. Furthermore, the method comprises controlling the initiation, using a remote signal to ignite the thermite charge. In some examples, the remote signal is conveyed through the bore (e.g. along the coiled tubing, fluid therewithin, or the tubing 42 or casing 28), such as using a pulse signal. Controlling the process comprises actively adapting the process, selecting when to initiate the process and when and how to vary a process parameter mid-process. The method is selectively controlled, obtaining feedback, and adapting the process according to the feedback, such as to vary one or more of: a supply of oxygen, a supply of oxidizing agent; a supply of fuel; a temperature; a fluid flow; a position of the downhole assembly.

Here, the method comprises a rigless operation. The method comprises an intervention or downhole operation from a rigless mobile surface unit. For subsea bores, as shown here, the method comprises operation from a floating vessel.

Figure 4:
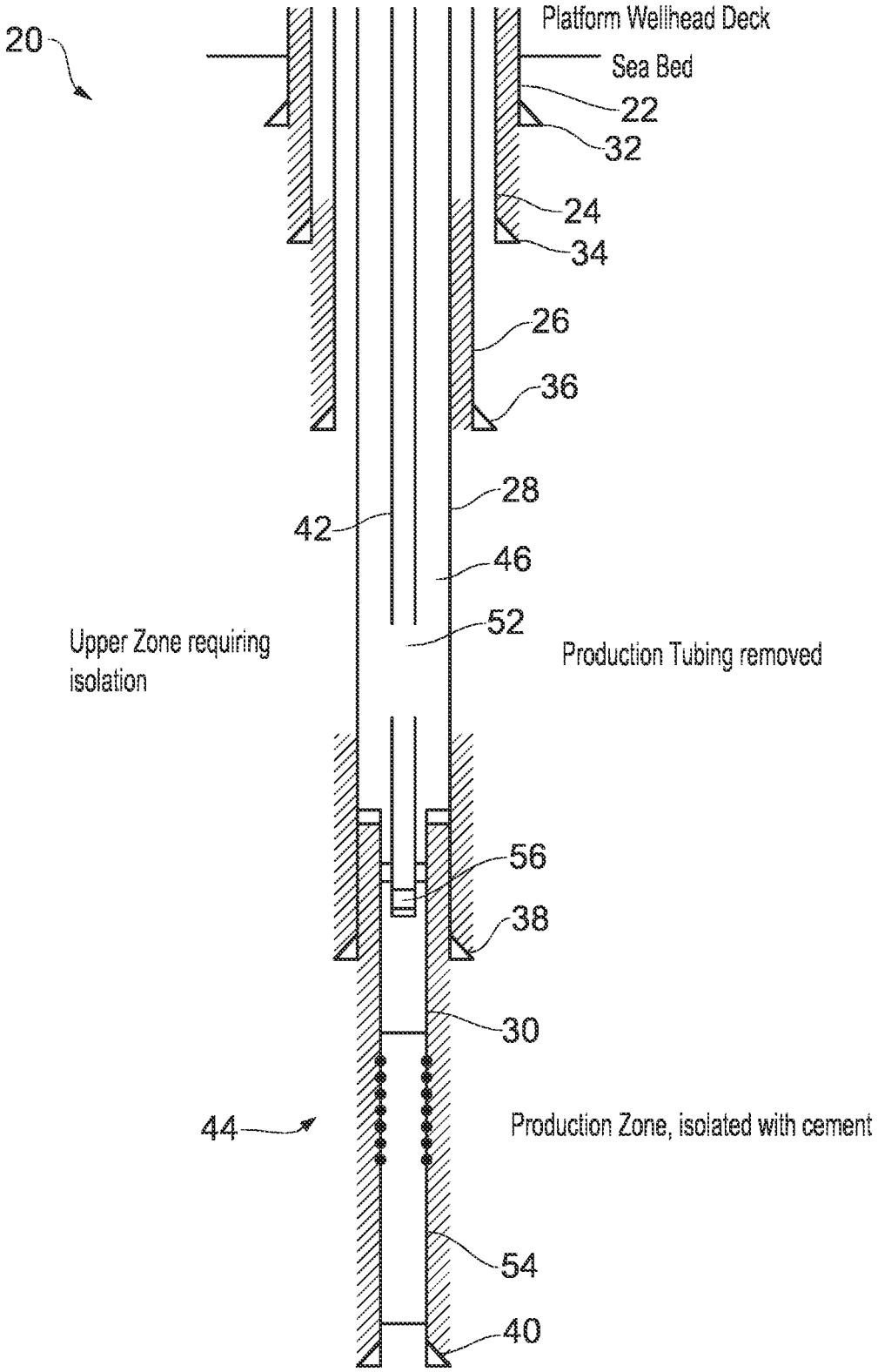
FIG. 4 is a subsequent view of the portion of the well bore of FIG. 3.
Figure 5:
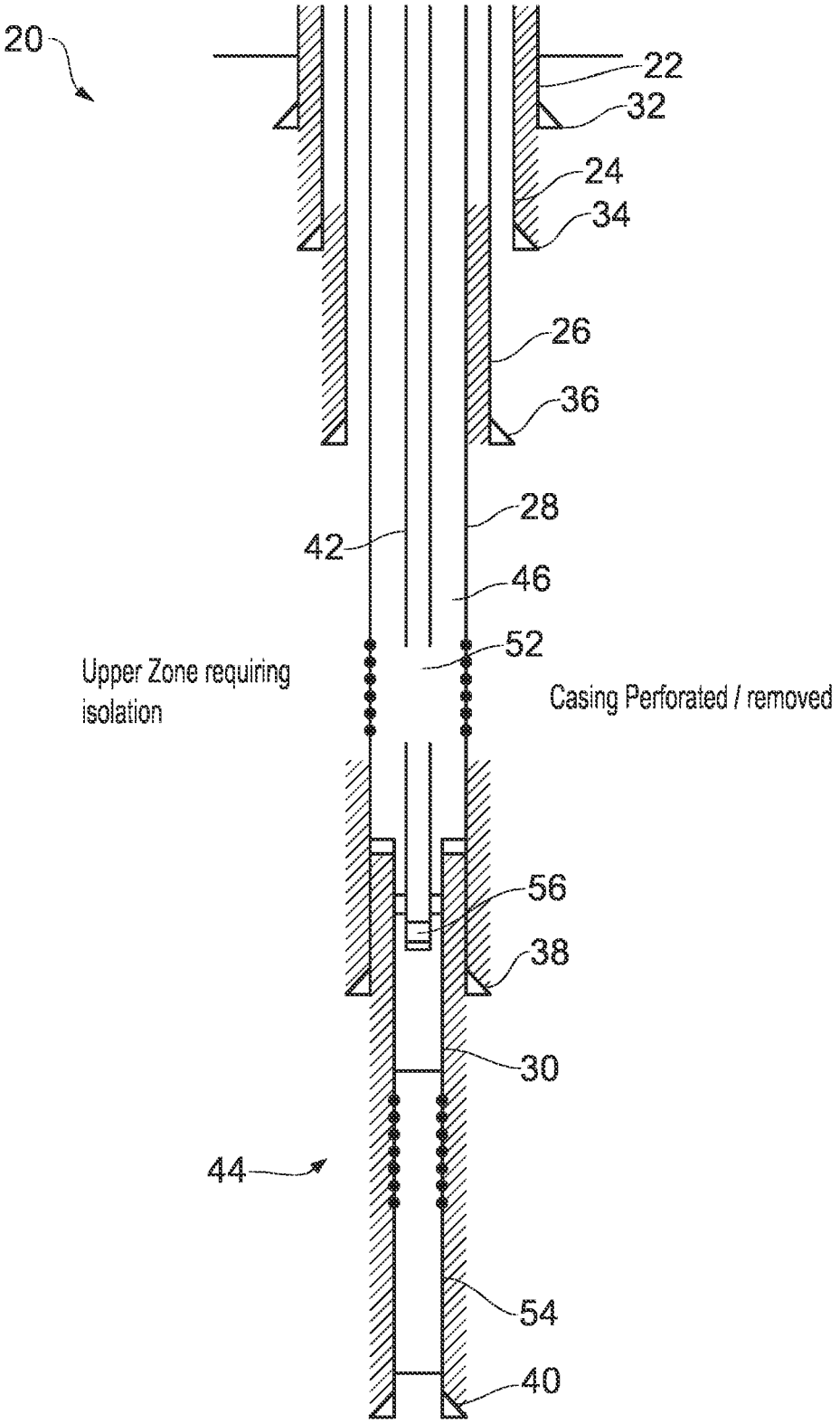
FIG. 5 is a subsequent view of the portion of the well bore of FIG. 4.
Figure 6:
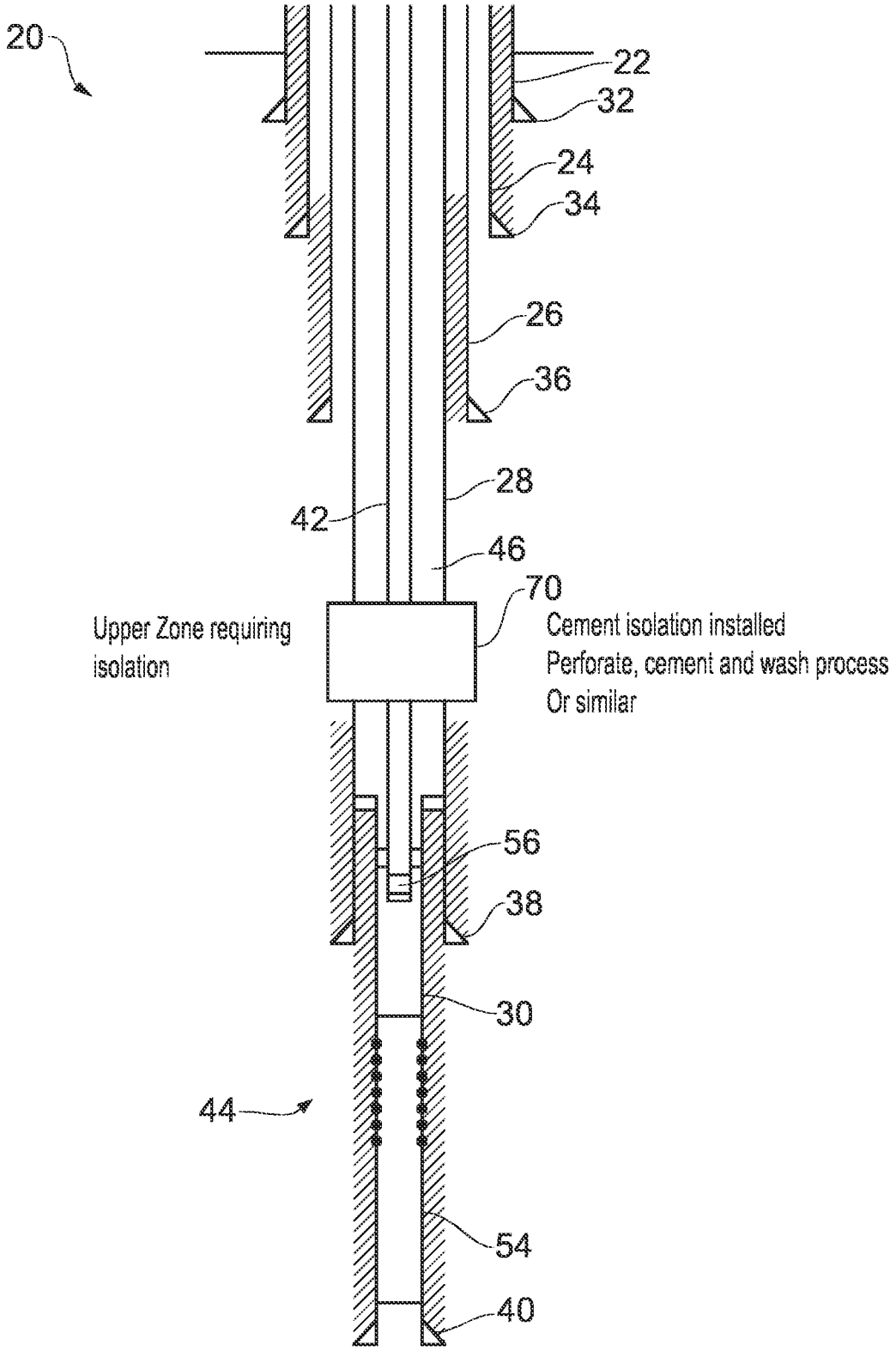
FIG. 6 is a subsequent view of the portion of the well bore of FIG. 5.

Referring now to FIG. 4, there is shown the portion of the well bore 20 following the downhole material removal with the downhole apparatus 60 of FIG. 6. As shown here, the method comprised removing material 42 to create an axial discontinuity, by removing material circumferentially so as to provide a split in the downhole well element represented here by the production tubing 42. The axial discontinuity eliminates a portion of the first annulus 46 that was previously between the production tubing 42 and the lined borewall 28. It will be appreciated that the coiled tubing 62 connected to the downhole assembly 60 has been pulled from the bore 20, allowing further subsequent operations, such as a perforation shown in FIG. 5. As will be appreciated, the method here comprises a plugging method, for abandonment, the method comprising the tubing 42 removal to allow placement of a plug 70 at the location 52 of the removed tubing 42, as shown in FIG. 6.

As shown in FIG. 4, the length of removed tubing 42 corresponds to an axial length of the heating device. Here, the method comprises removing only a portion of the downhole well element 42. In other examples, a shorter portion of the tubing 42 may be removed, merely to provide an axial discontinuity, allowing the portion of tubing 42 above the discontinuity to be pulled from the bore 42.

Figure 7:
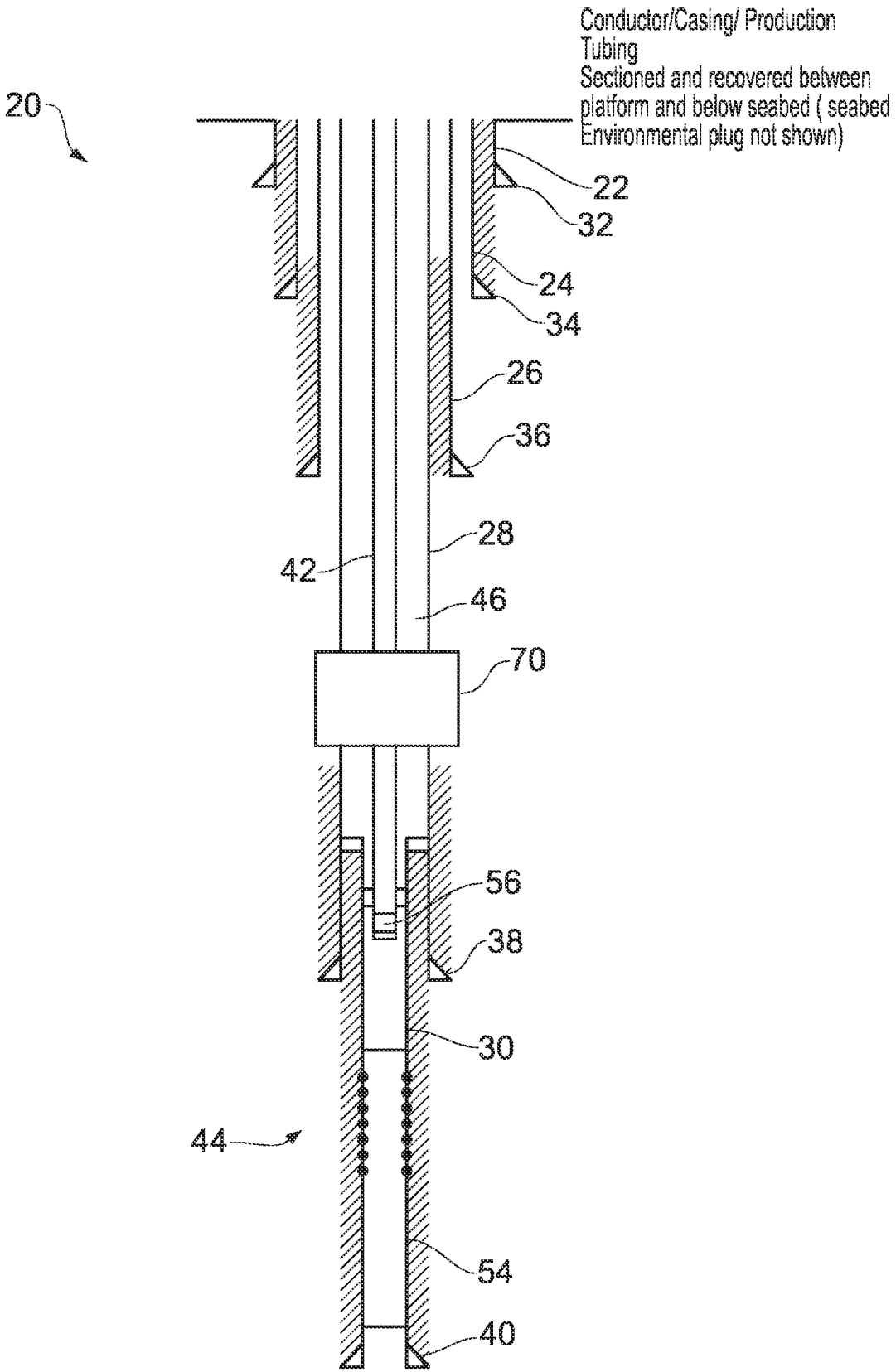
FIG. 7 is a subsequent view of the portion of the well bore of FIG. 6.

As will be appreciated from FIGS. 5, 6, and 7, the method here comprises processes subsequent to the material 42 removal with the heating device. The subsequent operations of preparing the target location 52 by perforating has used one or more perforating guns or assemblies run-in from surface after the heating device has been removed. As shown in FIG. 6, here the method comprises providing a cement plug 70 at the target location 52 to provide an absolute axial barrier, with the removed material 42 having removed a possible leakpath, along or within the production or the first annulus 46, that may otherwise have been present prior to the material removal. It will be appreciated that in other example methods, as an alternative to perforating the casing, a rock to rock window can be created for the cement plug to be placed within, the rock to rock window being created by the apparatus 60, such as where the apparatus 60 has a heating member that can be expanded once at the target location.

As shown in FIGS. 6 and 7, the method comprises providing a permanent well barrier extending across the full cross-sectional area of the bore 20, including any annuli, sealing both vertically and horizontally. FIG. 7 shows the removal or recovery of casing and tubing (and any conductor) between the platform and the seabed (or below the seabed).

It will also be appreciated that a subsequent step of providing an environmental plug at the mouth of the bore 20 (as exposed in FIG. 7) may be provided, such as to prevent passage into or out of the bore 20 at the seabed.

Here, removal comprises local removal, locally removing material from the tubing 42 that remains downhole in another downhole location (e.g. below the target location 52). In other examples, at least a portion of the locally removed material is removed or extracted from the bore, such as by retrieval uphole.

In other examples (not shown), the method comprises the removal of target material at a plurality of target locations. For example, the method comprises the removal of target material from a first downhole target location, then repositioning the downhole assembly at a second downhole target location (e.g. by partially pulling the downhole assembly) and then removing target material at the second downhole target location, all in a single run. Such a method comprises repositioning the downhole assembly without requiring a re-initiation of the heating device. In at least some examples, oxidation may continue uninterrupted whilst the downhole assembly is repositioned. In other methods, the oxidation is interrupted whilst the downhole assembly is repositioned, in at least some examples requiring a re-ignition of the heating device. Such methods comprise an interruption in or reduction of the supply of fuel and/or oxidizing agent during the repositioning. Additionally, or alternatively, the downhole assembly is repositioned at a sufficient rate so as not to substantially remove material between the first and second downhole target locations. It will be appreciated that the first downhole target location could be below or above the second target location, with the downhole assembly either being run-in further or partially pulled as appropriate.

In other examples (not shown), the method comprises protecting at least one part or region with a shield. For example, the method comprises providing a thermal shield downhole. The thermal shield comprises a high temperature resistant element, such as comprising, by way of example, ceramic and/or glass. The method comprises providing a plurality of shields. The method comprises positioning the shield/s downhole prior to initiation. The shield/s may protect one or more zone/s, area/s or portion/s downhole so as to prevent heating and/or oxidation and/or material removal therefrom. In at least one example, shield/s protect a zone, area or portion uphole of the target material, such as a non-oxidizing portion of the downhole assembly and uphole equipment and/or materials associated with or attached thereto (e.g. coiled tubing, uphole casing, or the like associated with or attached to the downhole assembly). Additionally, or alternatively, the shield/s protect a zone, area or portion downhole of the target material, such as a seal, plug or packer located below the downhole assembly, typically below the target material. In at least some examples, the shield/s protect a non-window portion, that is a portion of the downhole part or component not intended to be removed, such as a portion of casing, liner or tubular surrounding a window portion to be removed. In at least some examples, the method comprises a preparation for a sidetracking or secondary bore-drilling process.

Figure 8:
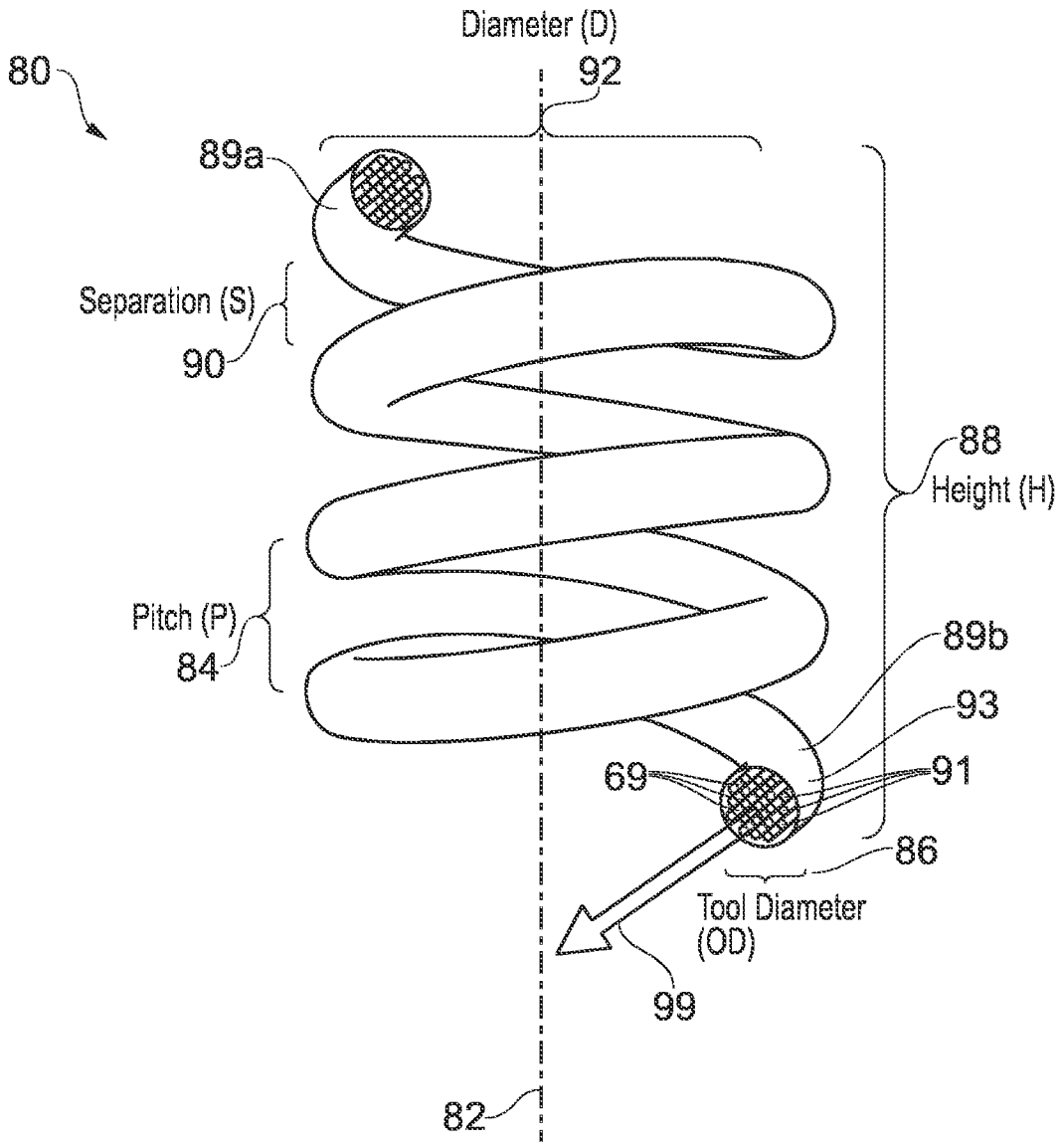
FIG. 8 is a schematic view of a helical thermic lance.

Referring now to FIG. 8, there is shown a schematic view of a helical thermic lance 80 for a heating device.

The helical thermic lance 80 comprises a circumferential extent, such as when viewed axially (e.g. when viewed along the longitudinal axis 82). The helical thermic lance 80 comprises a heating member that is configured to direct heat sequentially or temporally in an angular direction, such as radially or laterally relative to the longitudinal axis. Here, the heating member is configured to progressively direct heat around the longitudinal axis 82, such as at least 360 degrees around the longitudinal axis. Here, the heating member is configured to direct heat progressively in multiple revolutions around the longitudinal axis 82 (5 revolutions shown here). Accordingly, in use, the thermic lance 80 heats around the entire longitudinal axis 82, such as progressively or sequentially around an entire circumference of the longitudinal axis 82.

Here, the helical portion of the helical thermic lance 80 comprises a regular cylindrical helix, shown here as a right hand helix. Here, the helix comprises five revolutions; and a helix angle, the helix angle being defined as the angle between the helix and an axial line on the helix's right, circular cylinder or cone. The helix comprises a helix pitch 84, the pitch being the height of one complete revolution, measured parallel to the longitudinal axis 82 of the helix.

The helical thermic lance 80 comprises a member cross-section, shown here as a circular member cross-section. As will be appreciated, an outline of the cross-section of the thermic lance is defined by the container or sheath of the thermic lance (not shown). The cross-section is continuous along the helical length of the thermic lance. The cross-section comprises a non-solid or a hollow profile, such as with several openings 69 therein, the openings 69 extending along the entire length of the thermic lance 80. The openings allow the transmission of oxygen to the end 89*b* or tip of the thermic lance 80. For example, where the thermic lance 80 has a sheath 93 with multiple fuel rods 91 therewithin, the openings 69 correspond to the gaps between the fuel rods (e.g. where the fuel rods have non-tessellating cross-sections, such as circular). Here, additional oxygen can be supplied to the burning end 89*b* of the thermic lance 80 and also the target material by pumping oxygen down the annulus in which the thermic lance 80 is positioned. For example, where the thermic lance 80 is mounted on a coiled tubing string, oxygen may be pumped down the coiled tubing and optionally also down the inner central annulus in which the coiled tubing is located. It will be appreciated that the thermic lance 80 progressively shortens in use, with a burning tip progressively travelling along the helical path defined by the helical lance 80. Here, the thermic lance 80 comprises a circular cross-section, with wire fuel rods housed within a tube-shaped sheath, the circular cross section comprising a cross-sectional diameter 86.

The helical thermic lance 80 comprises a longitudinal length 88, shown here as a total separation between opposite ends 89*a*, 89*b* of the helical thermic lance 80 in a longitudinal direction. It will be appreciated that although schematically shown here as open at both ends 89*a*, 89*b*, the thermic lance 80 is generally closed or connected at at least one end, such as the upper end 89*a*, typically for connection to an oxygen supply through that closed connection. The helical thermic lance 80 comprises a total heating member length along the helical path, the heating member length being considerably longer than the longitudinal length of the heating member. The helical heating member length can be considered as unraveled or unwound, such heating member length being considerably longer than the longitudinal separation 88 between the opposite ends 89*a*, 89*b* of the heating member in its helical form. Accordingly, the helical thermic lance 80 can have a longer burn time for a same cross-sectional profile relative to a straight axial thermic lance (not shown) of similar longitudinal length.

The helical heating member comprises a longitudinal separation 90 between adjacent revolutions or turns of the helix. Here, the helical thermic lance 80 comprises no more than a maximum longitudinal separation 90 between adjacent revolutions or turns of the helix, such that there is no longitudinal separation between corresponding revolutions or turns of target material that is not sufficiently heated and/or oxidised. Accordingly the helical thermic lance 80 here is configured to remove a tube or cylindrical shaped volume of target material.

The longitudinal separation 90 between adjacent revolutions or turns of the helix is determined by or at least related to the pitch 84 and the cross-sectional property of the helical thermic lance 80. Here, the pitch 84 of the helix is the sum of the longitudinal separation 90 between adjacent revolutions or turns and an outer diameter 86 of the cross-section of the heating member.

The helix comprises a helix diameter 92, with an inner helix diameter being the helix diameter 92 less the outer diameter 86 of the cross-section of the heating member' and an outer helix diameter being the helix diameter 92 plus the outer diameter 86 of the cross-section of the heating member. The inner and outer diameters are defined when viewed axially, such as by circles in a plane perpendicular to the longitudinal axis 82 along which the helix extends. The helix outer diameter is selected according to an intended use, such as a minimum inner diameter of a target material into which the helical thermic lance is intended for insertion. The helix inner diameter is selected according to an intended use, such as an intended central passageway defined by an inner cylindrical volume within the inner diameter of the helix. The inner and outer diameters of the helix are determined by or related to the heating member cross-sectional property/ies, such as the heating member cross-sectional diameter 86. The outer helix diameter is greater than the helix inner diameter by an amount defined by the heating member cross-sectional diameter 86 (being twice the heating member cross-sectional diameter 86).

Here, each of the helix pitch 86; helix diameter 92; heating member longitudinal length 88; helix angle and heating member cross-section property 86 is selected according to the portion of target material to be heated. Here, the helix outer diameter is selected to be less than a minimum inner diameter of the target material to be heated. For example, where the helical thermic lance 80 is for heating a portion of a passage, such as a portion of a downhole wellbore, the helix outer diameter is selected to be less than a minimum diameter of a restriction, such as an inner diameter of a flow control device or flange, through which the helical thermic lance 80 must pass to reach the target material.

Although not shown here, in other examples the helical thermic lance comprises an expandable heating member. For example, the heating member comprises a helical member that is radially and/or longitudinally expandable. In at least some examples, the heating member is transferable to the target location in a collapsed configuration for expansion at the target location. Particularly where the heating member is a helical heating member for target material heating and/or removal within or of the enclosed volume, the heating member is transported to the target location in the collapsed configuration to allow or simplify the passage of the heating member thereto, such as through one or more restrictions. For example, where the target material to be heated and/or removed is or is in a passage, such as in a well bore or being a well apparatus, the heating device is transportable to the target location in the passage with the heating member radially collapsed so as to ease transport through a narrow diameter passage.

In at least some examples, the heating member is radially and/or longitudinally expandable by an active or forced expansion by an expander. For example, an apparatus comprising the expandable heating member also comprises an expansion cone for axial passage through the helical heating member so as to increase the inner diameter of the helix, thereby increasing the outer diameter of the helix. The heating member is selectively expandable, such as upon selected actuation of the expander.

Additionally or alternatively, the heating member is radially and/or longitudinally expandable according to a spring property of the heating member. For example, the helical heating member is transported in a collapsed configuration, with the heating member radially and/or longitudinally constrained. The radial and/or longitudinal constraint is achieved by an apparatus member, such as an apparatus sheath and/or apparatus piston. Alternatively, the constraint is external to the apparatus, such as defined by the enclosed volume into or through which the heating member is to pass. For example, the helical heating member for downhole well material heating and/or removal is collapsed at surface to radially fit within a casing or tubular, with the casing or tubular constraining the outer diameter of the helix. The helical member may then be transported downhole to the target location, the target location including a larger diameter, or acquiring a larger diameter during material removal, so as to allow or trigger expansion of the heating member to a larger outer helix diameter. The heating member is expandable before and/or during and/or after a heating. For example, the heating member is expandable after a first heating, being expanded to a greater diameter for a second heating.

In at least some examples, the heating member is longitudinally and/or radially expandable by an application of tension or compression to the heating member. For example, the heating member is selectively subjected to a tensile longitudinal force (e.g. by pulling on one or both ends) so as to longitudinally stretch the heating member, optionally thereby radially collapsing the heating member. Particularly where the heating member comprises the helix, the property/ies of the helix is adjustable, such as selectively adjustable. For example, the helix pitch is adjustable with the application of longitudinal tension to the heating member.

Additionally, or alternatively, the heating member comprises a collapsible heating member. For example, the heating member is radially collapsible to a smaller diameter, such as for passage or subsequent passage through a restriction prior to a heating. The heating member is collapsible by the passage of a member, such as a sheath, along the outer diameter of the heating member.

In use, the helical thermic lance 80 directs a jet of heat, indicated by an arrow 99 in FIG. 8. The helical form of the thermic lance 80 causes the jet 99 to be directed tangentially, such as when viewed axially along the central longitudinal axis 82 of the helix. It will be appreciated that as the helix is consumed during use, that the jet 99 is progressively directed outwards around 360 degrees for each revolution of the helix, as the burning end 89*b* of the helical thermic lance 80 tracks along the helical path of the lance 80. Accordingly, in use, the jet 99 is directed at an entire circumferential portion of a target material. In at least some examples, the jet 99 includes heat, oxidized and/or molten and/or gaseous material from the thermic lance 80, such as a plasma. The jet 99 can also optionally include oxygen, particularly where oxidation of the target material is desired.

Figure 9:
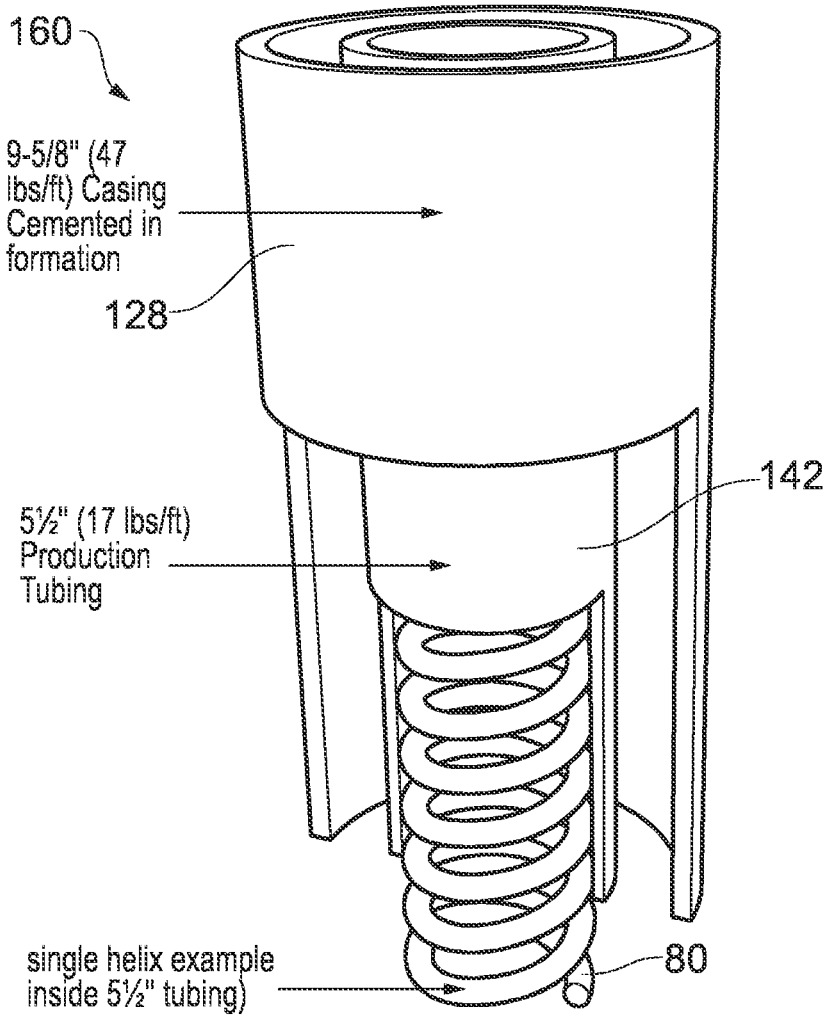
FIG. 9 is a schematic view of the helical thermic lance of FIG. 8 in use in a first heating device.

Referring now to FIG. 9, there is shown a portion of an apparatus 160 for heating, in use, shown here within a tubular 142 within a cased bore wall 128. As will be appreciated, the apparatus 160 shown here is a well apparatus 160 for removing material at a well, such as downhole; and/or for removing material at surface, such as for removing material from a surface apparatus 160 or installation (e.g. caisson or other tube-shaped equipment). As with preceding apparatus 60, the apparatus 160 shown here comprises a heat source; and a fuel supply and an oxidant supply. The apparatus 160 comprises a heating device for removing at least a portion of the target material. Here, the target material is an axial portion of a tubular 142 within a cased bore wall 128, the tubular 142 defining a passage. Here, the heating device comprises the thermic lance 80 of FIG. 8. The thermic lance 80 comprises a similar sheath and fuel to the apparatus 60 of FIG. 3.

The thermic lance 80 comprises a longitudinal extent that extends in an axial direction along the enclosed volume of the tubular 142 when the apparatus 160 is in use. The heating device comprises a longitudinally extending heating member. The heating device is configured to heat along the axial extent. The apparatus 160 is configured to heat progressively along the axial extent, such as by progressive heating longitudinally along the thermic lance 80.

The thermic lance 80 is configured to oxidise and heat transversely, such as transversely to a longitudinal axis of the apparatus 160 and the passage. The apparatus 160 is configured to oxidise and heat laterally. Here, the apparatus 160 is configured to direct heat transversely, substantially tangentially, such as when viewed axially (e.g. with a tangential component or vector).

It will be appreciated that the apparatus 160 can cause the target material to be removed by melting and/or oxidation, in use. For example, heat emanating directly or indirectly from the apparatus 160 may heat the target material beyond its melting point. The target material melts accordingly and can fall away.

In at least some examples, the apparatus 160 comprises an inlet (not shown) for receiving oxidant to be supplied, such as via a conduit or passage (e.g. from a remote source). The apparatus 160 comprises one or more valves for controlling the supply of oxidant to the thermic lance 80. Here, the apparatus 160 comprises a controller (not shown) for controlling the supply of oxidant to the heating member. The apparatus 160 comprises an ignition, which is a remotely controllable electrical ignition (not shown).

It will be appreciated that although shown here for removing a circumferential window from a 5½" (17 lbs/ft) production tubing inside a 9⅝" (47 lbs/ft) casing cemented in formation, other dimensions and types of target material can be removed with this or other helical thermic lance 80, such as with helix properties configured for the particular target material (e.g. with a smaller or larger helix diameter as appropriate).

Figure 10:
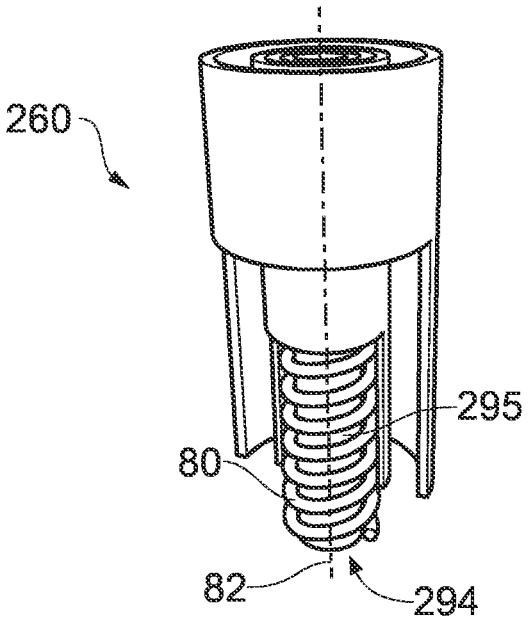
FIG. 10 is a schematic view of the helical thermic lance of FIG. 8 in use in a second heating device.

Referring now to FIG. 10, there is shown an apparatus 260 for heating, in use, generally similar to that shown in FIG. 9. Accordingly, the apparatus 260 comprises a heating device with the helical thermic lance 80 of FIG. 8. Again, the apparatus 260 is shown here within a tubular within a cased bore wall. As shown here, the heating device comprises a central passage 294, located radially inwards of the helical thermic lance 80, the central passage 294 being located in the helix inner diameter. Here, the central passage 294 includes the central longitudinal axis 82 of the helical thermic lance. The central passage 294 is parallel to and collinear with the central longitudinal axis 82 of the helical thermic lance 80. Here, the central passage 294 comprises a central member 295, here being an enclosed hollow central member 295 defining a bore or throughbore therewithin. The central passage 294 is configured for the transmission of signals and/or materials therethrough, such as oxygen, to one or more heating devices. The signal/s comprises one or more of: an actuation signal/s; a control signal/s; a measurement signal/s. In at least some examples, the signals comprises the incoming actuation and the deactuation signals for the thermic lance 80 and a further thermic lance (not shown); and an outgoing measurement signal indicative of the heating process, such as to indicate a temperature and/or a material removal status. The central passage 294 comprises one or more of: an electrical line/s; a fluid line/s; a fibreoptic line; an acoustic transmission line; an electromagnetic transmission line. The central passage 294 is configured to protect from heat. For example, here, where the apparatus 260 is configured to direct heat laterally outwards, the central passage 294 located centrally, at an inner diameter, is configured to inherently receive less heat, relative to radially outside the helical thermic lance 80. Here, the central passage 294 is additionally thermally shielded by the central member 295 comprising a cylindrical thermal shield. The apparatus comprises a controller, such as for controlling ignition and/or extinction of the helical thermic lance 80. In at least some examples, the controller is located remotely from the thermic lance 80, such as at or near an oxygen source therefor.

Figure 11A:
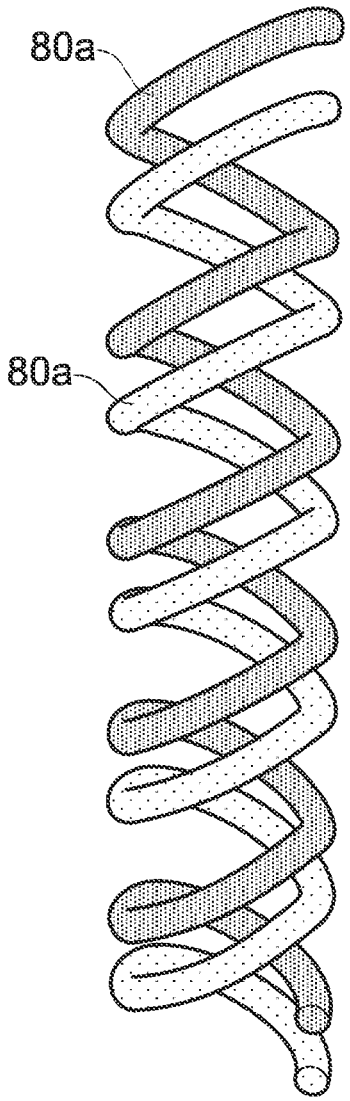
FIG. 11*a* is a schematic view of a pair of helical thermic lances.
Figure 11B:
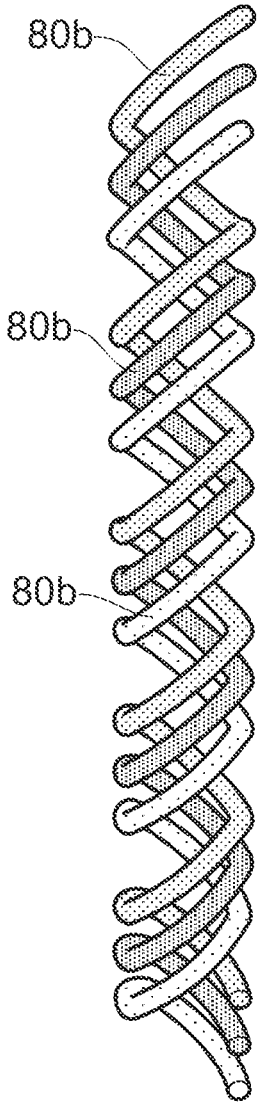
FIG. 11*b* is a schematic view of three helical thermic lances.
Figure 11C:
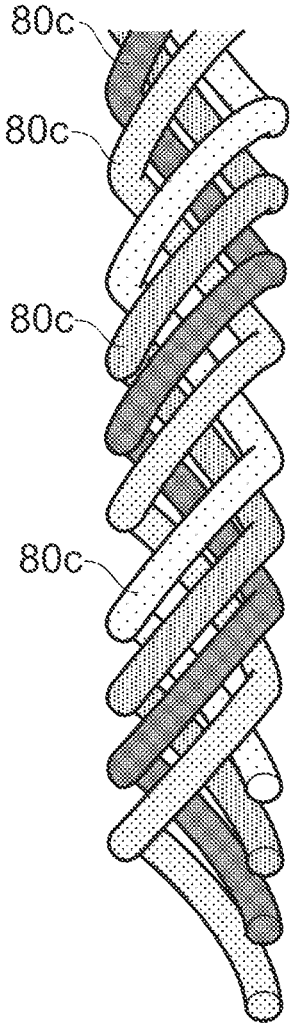
FIG. 11*c* is a schematic view of four helical thermic lances.

Referring now to FIGS. 11*a*, 11*b* and 11*c*, there are shown examples of arrangements of a plurality of thermic lances 80. As can be appreciated by comparing the figures, the helix angle, pitch and number of revolutions of each helical thermic lance 80 is adapted to account for the number of helical thermic lances 80 in the arrangement.

At least some example apparatus comprises a plurality of helical thermic lances 80, such as shown in FIG. 11*a*, 11*b* or 11*c*. The heating device of the apparatus comprises the plurality of helical thermic lances 80 as shown in the respective arrangements. For example, the heating device comprises two, three or four helical thermic lances 80, respectively. Each of the helical thermic lances 80 is arranged at a similar longitudinal position.

The plurality of helical thermic lances 80 is configured to heat and/or oxidise a same portion of target material. The same portion of target material is located at the same target location. Each of the helical thermic lances 80 is configured to remove a helical-form portion of target material, each helical form portion rotationally spaced. Each of the helical thermic lances 80 is configured to remove a helical-form portion of target material such as to remove a tube-shaped or cylindrical volume of target material when the plurality of helical-form portions is combined. The plurality of helical thermic lances 80 is configured for substantially simultaneous actuation. Actuation comprises ignition. The plurality of helical thermic lances 80 is configured for simultaneous heating. The plurality of helical thermic lances 80 is configured to concurrently heat. The plurality of helical thermic lances 80 is singularly controllable, such as via a single controller for controlling the plurality of helical thermic lances 80. The plurality of helical thermic lances 80 is configured for simultaneous oxygen supply, such as from a single oxygen source. The plurality of helical thermic lances 80 is configured for substantially simultaneous deactuation. Deactuation comprises extinction, such as by cessation of the oxygen supply.

It will be appreciated that in at least some examples, the plurality of thermic lances may be noncontemporaneously activated. For example, at least some of the plurality of thermic lances may be sequentially activated, such as with a first thermic lance 80*a* heating a first target material (e.g. the production tubing 42 of FIG. 2) and a second thermic lance 80*a* heating a second target material (e.g. the casing 28 of FIG. 2). In at least some examples, the first and second target materials are located at a similar axial position (e.g. similar bore depth); whilst in other examples, the first and second target materials are axially spaced (e.g. the heating device is moved from a first target location to a second target location between activation of the first and second thermic lances 80*a*).

Two or more of the helical thermic lances 80 comprises one or more similar properties. For example two or more of the helical thermic lances 80 comprises similar helical thermic lances 80, comprising similar: helix pitch; heating member longitudinal length; helix angle and/or helical thermic lance 80 cross-section property/ies. In at least some examples, the plurality of helical thermic lances 80 have similar properties, arranged longitudinally coincident, with the helical thermic lances 80 rotationally offset, such that the two or more helical thermic lances 80 are arranged circumferentially around the plane perpendicular to the longitudinal axis. The helical thermic lances 80 are evenly rotationally offset. For example, where there are two longitudinally coincident similar helical thermic lances 80, such as shown in FIG. 11*a*, the helical thermic lances 80 are arranged rotationally offset by 180 degrees. As shown in FIGS. 11*a*, 11*b* and 11*c*, the burning ends of each helical thermic lance are arranged to track along their respective helical paths at a similar rate, with the burning ends being axially aligned in use as depicted in FIGS. 11*a*, 11*b* and 11*c* (e.g. with a burning end of a first lance 80*a* directly above a burning end of a second lance 80*a*). It will be appreciated that in other examples, the burning ends in use may be axially misaligned, such as diametrically opposed. Each burning end of a helical thermic lance 80 provides a jet 99 directed tangentially, noting also that the jet will be directed angularly according to a pitch angle of the helix. The longitudinal separation between adjacent revolutions or turns of a single helix of each helical thermic lance 80 exceeds the maximum longitudinal separation, such that a corresponding helical portion of the target material is insufficiently heated by a single thermic lance 80, which would leave the corresponding portion of the target material unheated and unremoved—in the absence of the other of the thermic lances 80*a*. Accordingly, each thermic lance 80 is configured to heat only a helical portion of target material. However, the corresponding portions of each of the thermic lances 80 overlap such that the combined heated target material of both of the thermic lances 80 is a cylindrical sufficiently heated volume.

In other examples (not shown), it will be appreciated that the helical thermic lances comprise dissimilar properties. For example, particularly where the plurality of helical thermic lances are non-contemporaneously activated, then the helical thermic lances may be non-identical. Especially where the thermic lances are intended to heat different target materials, then the thermic lances can have different properties. For example, where a first thermic lance is for heating a first target material, such as an inner target material (e.g. the production tubing 42 of FIG. 2); and a second thermic lance is for heating a second target material, such as an outer target material (e.g. the casing 28 of FIG. 2), then the second thermic lance may be configured to provide a different jet of heat from the first thermic lance. In at least some examples, the second thermic lance has a greater outer diameter 86 (not shown), allowing the second thermic lance to jet more heat to bridge a greater gap to the outer target material. It will be appreciated that the first and second thermic lances can have a similar helix diameter 92 such as to allow both thermic lances to be positioned within the inner target material.

Figure 12:
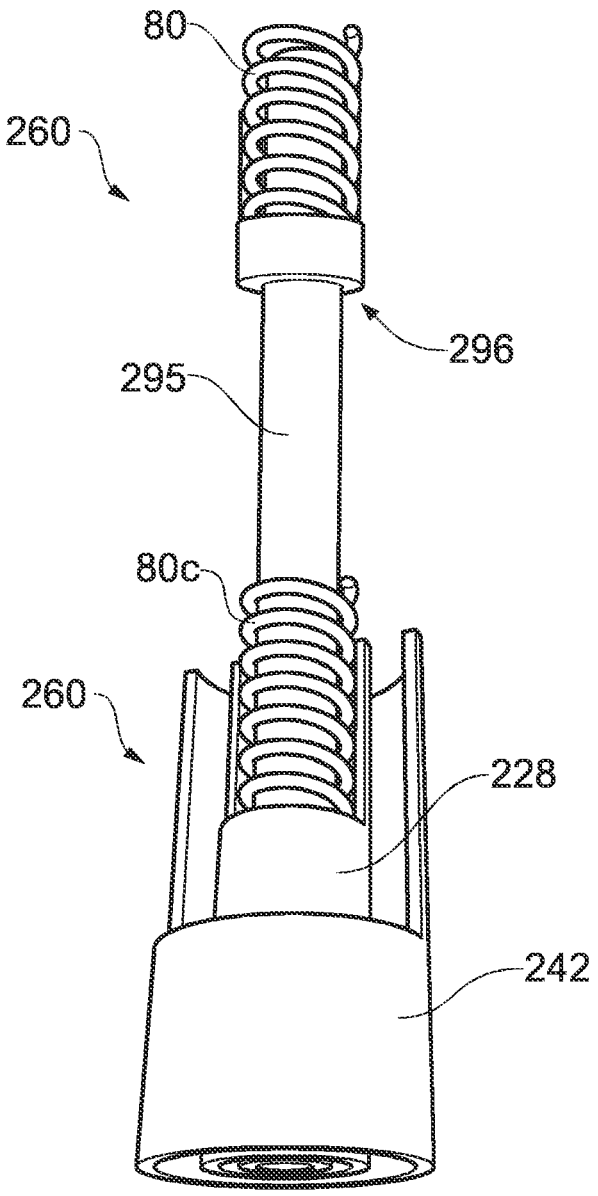
FIG. 12 is a schematic view of an apparatus comprising a pair of second heating devices of FIG. 9.

Referring now to FIG. 12, there is shown an apparatus 260 comprising a plurality of heating devices, each heating device comprising a thermic lance 80. Here, the plurality of heating devices are spaced longitudinally, along a longitudinal axis of a downhole tool string. Each of the plurality of heating devices is similar, each comprising a single helical thermic lance 80. The plurality of heating devices is selectively controllable. Each of the heating devices is independently controllable. For example, a supply of oxidant to a first heating device is controlled separately from a supply of oxidant to a second heating device. The plurality of heating devices is selectively independently actuatable. For example the first heating device is actuated prior to the second heating device. Here a controller 296 more proximal the heating device is included. It will be appreciated that the apparatus 260 can optionally include other devices, such as selected from one or more of: perforation guns, logging tools, cementing tools, plugs, packers.

Figure 13:
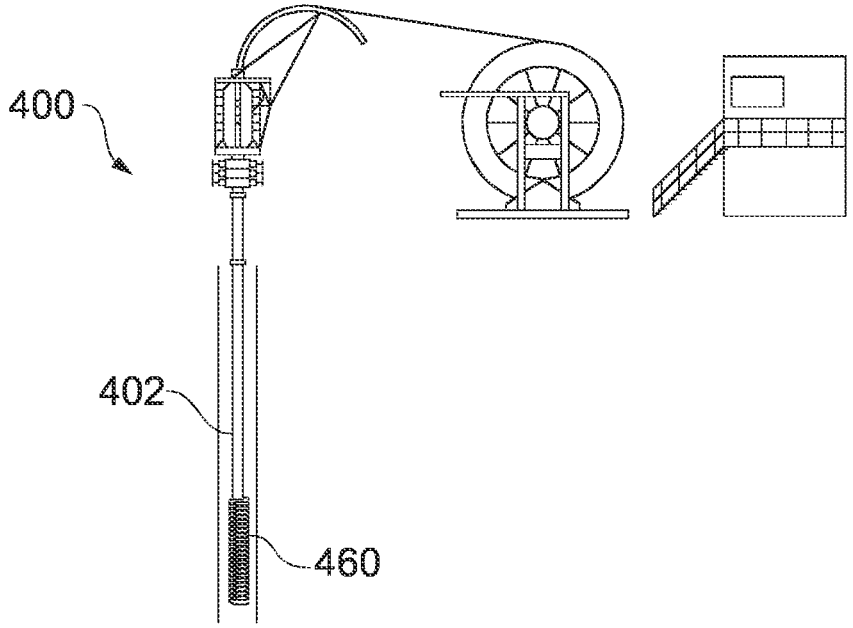
FIG. 13 shows an example of a surface equipment package for a downhole apparatus.

FIG. 13 shows an example of a surface equipment package 400 for a downhole apparatus. Here the package 400 comprises a coiled tubing package, with a liquid oxygen converter and pump for pumping oxygen through the coiled tubing 402 to the downhole apparatus 460. It will be appreciated that the coiled tubing 402 may be connected to a central member of a heating device of the downhole apparatus, such as to allow selective passage of oxygen internally to a helical thermic lance associated with the heating device. In addition, oxygen may be supplied externally to a target location, such as passing from the coiled tubing into an annulus in which the downhole apparatus 460 is located.

Figure 14:
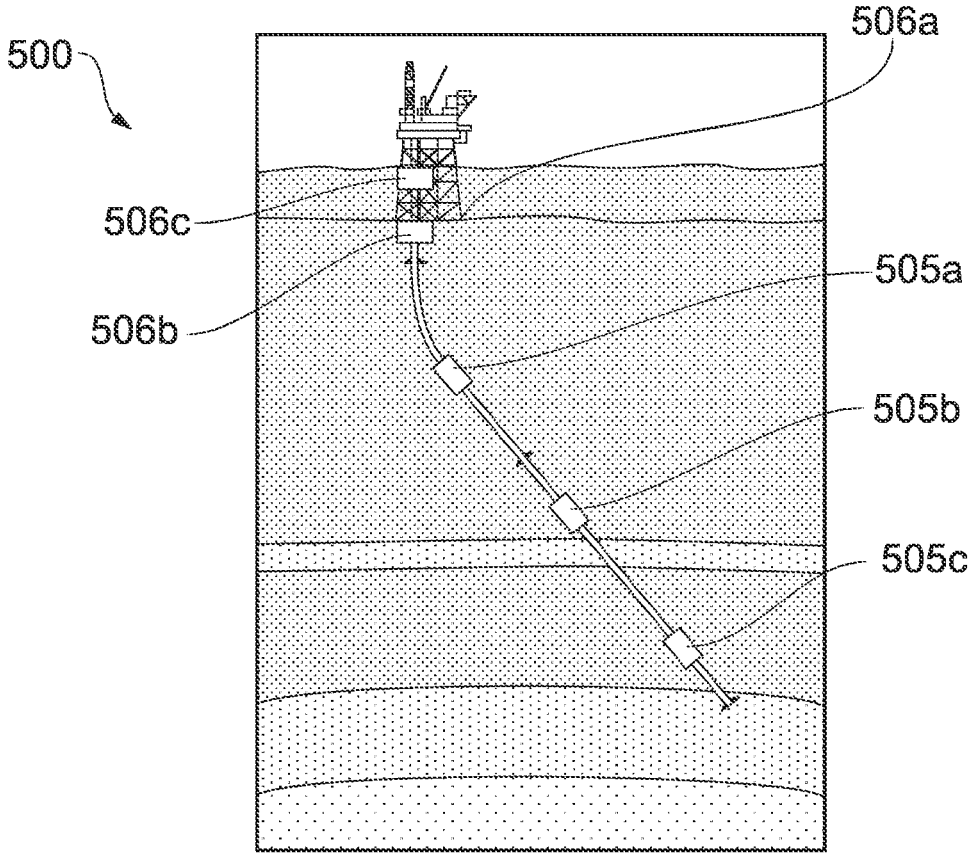
FIG. 14 schematically illustrates a plurality of target locations for material heating and/or removal.

Referring now to FIG. 14, there is shown an example well 500, with selected target locations 505*a*, 505*b*, 505*c*, 506*a*, 506*b*, 506*c*. Multiple target locations 505*a*, 505*b*, 505*c* are located downhole, such as for removing tubing and/or casing in preparation for plugging and abandonment. It will be appreciated that multiple target locations 505*a*, 505*b*, 505*c* may be subjected to simultaneous heating, such as by multiple heating devices located at each target location 505*a*, 505*b*, 505*c*. Alternatively, the target locations 505*a*, 505*b*, 505*c* may be subjected to sequential heating, such as by pulling a heating device with multiple thermic lances from a lowermost target location 505*c*, to an upper target location 505*b*—after first heating the lowermost target location 505*c*. Multiple target locations 506*a*, 506*b*, 606*c* are located at surface, such as for removing material from a surface apparatus or installation (e.g. caisson or other tube-shaped apparatus).

Figure 15:
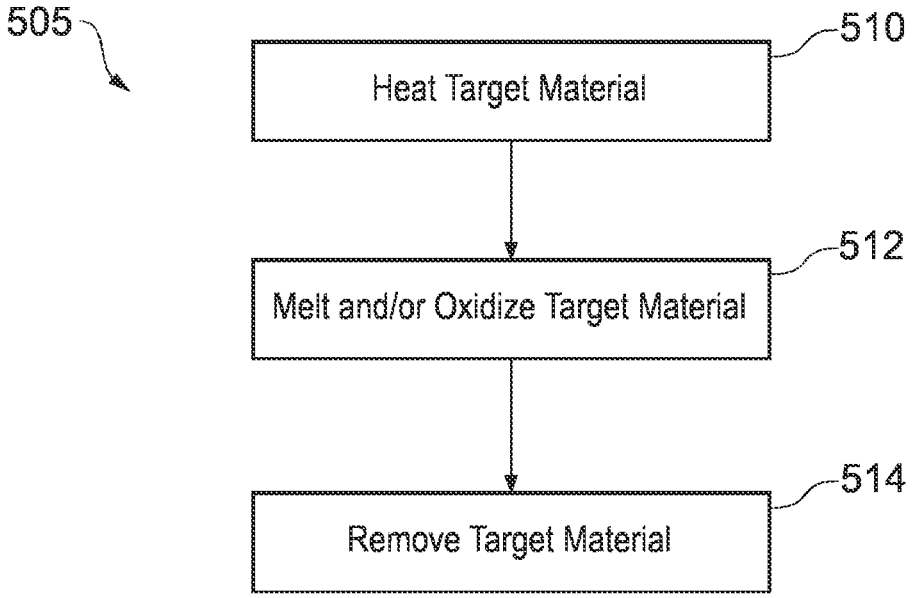
FIG. 15 is a flow chart of a method in accordance with another example.

Referring now to FIG. 15, there is shown a flow chart generally similar to that shown in FIG. 1. Here, the method 505 comprises a first step 510 of heating; followed by a subsequent step 512 of melting and/or oxidizing target material and a further step 514 of removing the oxidized target material. It will be appreciated that in at least some examples the steps may be linked or even concurrent. For example, where target material is melted the target material may be concurrently removed by the melted target material dropping away as it melts.

It will be appreciated that any of the aforementioned device or apparatus may have other functions in addition to the mentioned functions, and that these functions may be performed by the same device or apparatus.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims.

The applicant indicates that aspects of the present disclosure may consist of any such individual feature or combination of features. It should be understood that the embodiments described herein are merely exemplary and that various modifications may be made thereto without departing from the scope of the disclosure. For example, it will to be appreciated that although shown here as a bore with a vertical orientation, other bores may have other orientations.

For example, other example bores may have at least non-vertical portions, such as deviated or horizontal sections or bores. It will be appreciated that as used herein, 'uphole' may refer to a direction towards surface or an entry point to the bore, without necessarily being purely vertically upwards. Likewise, 'downhole' may not necessarily be purely directly downwards, such as merely away from a bore entry point in a deviated or horizontal bore.

In addition, features disclosed for a particular example use or application, may be applicable for other uses or applications. For example, features disclosed in relation to downhole examples, such as for downhole target material, may be applicable to other target material, not necessarily downhole.

It will be appreciated that example or embodiments can be realized in the form of hardware, software or a combination of hardware and software. Any such software may be stored in the form of volatile or non-volatile storage, for example a storage device like a ROM, whether erasable or rewritable or not, or in the form of memory, for example RAM, memory chips, device or integrated circuits or on an optically or magnetically readable medium, for example a CD, DVD, magnetic disk or magnetic tape or the like. It will be appreciated that the storage devices and storage media are embodiments of machine-readable storage that are suitable for storing a program or programs comprising instructions that, when executed, implement embodiments of the present disclosure.

Accordingly, examples or embodiments provide a program comprising code for implementing apparatus or a method as claimed in any one of the claims of this specification and a machine-readable storage storing such a program. Still further, such programs may be conveyed electronically via any medium, for example a communication signal carried over a wired or wireless connection and embodiments suitably encompass the same.

Although various denotations have been used throughout the description, tubing, liner, casing etc. should be understood as pipe or tubular of steel or other metals or materials such as used in well operations. In at least some examples, by the use of the described invention, all operations can be performed from a light well intervention vessel, offshore platform installation, land-based well site or similar, and the need for a rig is eliminated. Prior to the ignition of the fuel-oxidizing mixture, the well may be pressure tested to check if the seal is tight. This may be performed by using pressure sensors or other methods of pressure testing, such as conventionally.

It will also be appreciated that although shown here with particular reference to wells, other applications and uses are also disclosed. For example, a helical thermal lance for non-well use is also disclosed, particularly for use in enclosed volumes such as passages. Especially where an exterior of the passage is poorly accessible, then the helical thermic lance can have special utility. Accordingly, pipes, such as in nuclear, chemical and other processing; or buildings or transport networks; can be heated and/or removed by the helical thermic lance.

Likewise, where a helical thermic lance has been shown here, in other examples, the heating device may comprise additional or alternative heating elements or members. For example, in at least some embodiments, the heating device may comprise a helical heating element in the form of a combustible material helically arranged. The combustible material may be a highly exothermic combustible, such as a powder charge, with the helical arrangement being provided by a container, matrix (e.g. cylindrical or helical matrix) or the like for supporting the combustible material.

The invention claimed is:

1. A well material removal apparatus for removing material at a well, the well material removal apparatus comprising a heating device for heating a target material, the heating device being a helical thermic lance configured to progressively jet heat along a helical path to heat the target material for removal, wherein the helical thermal lance is configured to jet heat laterally relative to a longitudinal axis of the heating device, the longitudinal axis being a central longitudinal axis along which the helix of the helical thermic lance extends.

2. The well material removal apparatus of claim 1, wherein the helical thermic lance comprises a helical housing.

3. The well material removal apparatus of claim 2, wherein the helical heating member comprises at least one or more of the following predetermined properties according to intended use: longitudinal separation between adjacent revolutions or turns; a heating member cross-section property/ies; helix pitch; helix diameter; heating member longitudinal length; helix angle.

4. The well material removal apparatus of claim 1, wherein the heating member comprises an expandable heating member, the heating member being at least one of: radially expandable; and longitudinally expandable.

5. The well material removal apparatus of claim 1, wherein the heating member comprises an inlet for receiving oxidant, and the apparatus comprises one or more valves for controlling the supply of oxidant to the heating member.

6. The well material removal apparatus of claim 1, wherein the heating device comprises a central passage located radially inwards of the heating member, wherein the central passage comprises an enclosed hollow central member defining a bore configured for the transmission of signals and/or materials therethrough.

7. The well material removal apparatus of claim 1, wherein the heating device comprises a plurality of heating members, wherein the heating members are arranged longitudinally coincident, with the heating members rotationally offset, such that the two or more heating members are arranged circumferentially around a plane perpendicular to the longitudinal axis.

8. The well material removal apparatus of claim 1, wherein the well material removal apparatus comprises a plurality of heating devices, wherein the plurality of heating devices are spaced longitudinally and are selectively independently controllable.

9. The well material removal apparatus of claim 1, wherein the apparatus is for downhole heating.

10. A method of removing material at a well, the method comprising progressively jetting heat along a helical path with a helical thermic lance configured to jet heat laterally relative to a central longitudinal axis along which a helical of the helical thermic lance extends to heat a target material for removal, wherein the helical thermic lance is configured to progressively jet the heat along a helical path such that heat is jetted laterally relative to a longitudinal axis of the well to progressively helically heat the target material.

11. The method of claim 10, wherein the method comprises transporting the heating device to or towards a target location;

providing an oxidant at the target location;

heating the target material at the target location to facilitate the removal of the target downhole material; and removing the target material.

12. The method of claim 11, wherein the target location is in a passage, the method comprising transporting the heating device in the passage to the target location.

13. The method of claim 10, wherein the method comprises heating with a plurality of heating members and selectively independently controlling the plurality of heating members.

14. The method of claim 10, wherein the method comprises transporting the heating device in a collapsed configuration to the target location and expanding the helical heating member at the target location.

15. The method of claim 10, wherein the method comprises downhole heating.

16. The method of claim 10, wherein the method comprises oxidizing the target material in an exothermic reaction and generating sufficient heat to heat additional target material sufficiently to propagate the oxidation process.

17. The method of claim 10, wherein the method comprises melting the target material.

18. A well material removal apparatus for removing material at a well, the well material removal apparatus comprising a heating device for heating a target material, the heating device being a helical thermic lance for progressively jetting heat along a helical path, the helical thermic lance being configured to jet heat laterally relative to a longitudinal axis of the well to progressively helically heat the target material for removal.

* * * * *